US008091398B2

(12) United States Patent
Dixon et al.

(10) Patent No.: US 8,091,398 B2
(45) Date of Patent: Jan. 10, 2012

(54) APPARATUS AND METHOD FOR THE MANUFACTURE OF A SPRING UNIT

(75) Inventors: Howard Martin Dixon, Rossendale (GB); Paul Rodgers, Bacup (GB)

(73) Assignees: Paul Rodgers, Lancashire (GB); David Trickett, Rossendale (GB)

( * ) Notice: Subject to any disclaimer, the term of this patent is extended or adjusted under 35 U.S.C. 154(b) by 839 days.

(21) Appl. No.: 11/912,354

(22) PCT Filed: Apr. 26, 2006

(86) PCT No.: PCT/GB2006/001529
§ 371 (c)(1),
(2), (4) Date: Jul. 23, 2008

(87) PCT Pub. No.: WO2006/114624
PCT Pub. Date: Nov. 2, 2006

(65) Prior Publication Data

US 2008/0282759 A1 Nov. 20, 2008

(30) Foreign Application Priority Data

Apr. 26, 2005 (GB) ..... 0508393.6

(51) Int. Cl.
*B21F 35/02* (2006.01)
*B21F 3/00* (2006.01)

(52) U.S. Cl. ..... 72/137; 140/103

(58) Field of Classification Search ..... 72/135, 72/137, 138; 140/102, 102.5, 103
See application file for complete search history.

(56) References Cited

U.S. PATENT DOCUMENTS

| | | | |
|---|---|---|---|
| 3,188,845 | A | 6/1965 | Gerstorfer |
| 3,547,163 | A | 12/1970 | Dickey |
| 4,156,442 | A | 5/1979 | Sykes |
| 4,886,249 | A | 12/1989 | Docker et al. |
| 5,105,642 | A | 4/1992 | Mohr et al. |

(Continued)

FOREIGN PATENT DOCUMENTS

| | | |
|---|---|---|
| EP | 0248661 | 9/1987 |

(Continued)

OTHER PUBLICATIONS

PCT/GB2006/001529, International Preliminary Report on Patentability, dated Oct. 30, 2007.

(Continued)

*Primary Examiner* — Teresa Ekiert
(74) *Attorney, Agent, or Firm* — John V. Daniluck; Bingham McHale LLP

(57) ABSTRACT

Apparatus and methods for use in the manufacture of a spring unit for incorporation into an upholstered article, for example, a mattress, cushion or the like. Coil formation apparatus includes a drive shaft used to control movement of a coil pitch guide member and a link member comprising a connecting rod connected to a radius arm of the drive shaft by means of an adjustable connection. A coil interlinking process comprises compressing a first coil to define a clearance extending a second coil passed the first coil via the clearance, allowing the first coil to extend across the clearance, and contracting the second coil such that the second coil engages the first coil thereby interlinking the first and second coils. Spring unit manufacturing apparatus comprises a plurality of jaw pairs each comprising a first fixed jaw and a pivotal second jaw, the pivotal second jaw being pivoted by a cam and linkage assembly that is operated by a rotary drive shaft.

8 Claims, 18 Drawing Sheets

U.S. PATENT DOCUMENTS 5,875,664 A 3/1999 Scott et al.

FOREIGN PATENT DOCUMENTS

| | | |
|---|---|---|
| GB | 1095980 | 12/1967 |
| GB | 1104884 | 3/1968 |
| GB | 1327795 | 8/1973 |
| GB | 1377775 | 12/1974 |
| GB | 1399811 | 7/1975 |
| WO | 96/38240 | 12/1996 |
| WO | 2006/114624 A3 | 11/2006 |

OTHER PUBLICATIONS

EP 06726914.2-2302: Office Action dated Apr. 21, 2008 and Response filed Jul. 28, 2008.

EP 09001852.4-2302: Search Report dated Mar. 27, 2009; Office Action dated Nov. 17, 2009; and Response dated Dec. 4, 2009.

CN 2006800214625: first Office Action.

Close up view of area 'A'

APPARATUS AND METHOD FOR THE MANUFACTURE OF A SPRING UNIT

CROSS REFERENCE TO RELATED APPLICATIONS

This application claims priority to International Patent Application No. PCT/GB2006/001529, filed Apr. 26, 2006, which claims priority to GB patent application No. 0508393.6, filed Apr. 26, 2005, both of which are herein incorporated by reference.

FIELD OF THE INVENTION

The present invention relates to apparatus and method for the manufacture of a spring unit for use in an upholstered article, for example, a mattress, cushion or the like.

BACKGROUND OF THE INVENTION

A spring unit for an upholstered article comprises an array of interconnected helical coil springs formed from metal wire.

The production of such a spring unit conventionally comprises three principal steps that are described below with reference to FIG. 1.

First the wire is coiled to form the springs. In order to do this, wire 1 from a reel 2 is fed in the direction of arrow A to a coiling machine 3 to form a coiled wire 4 consisting of a continuous series of alternating left and right-handed helical coils 5, 6 interposed with substantially straight sections of wire 7. The coiled wire 4 is folded at appropriate intervals as it emerges from the coiling machine so that the straight sections of wire 7 are parallel to one another and adjacent left and right-handed coils 5, 6 are arranged so that their central longitudinal axes are approximately disposed in parallel.

The folded coils 4 are fed to a linking table 8 where the adjacent right and left-handed coils are interlinked. The strings of coils 9 are periodically cut into predetermined lengths and each string 9 fed on to a storage reel 10 ready for use in the final step of the process. To form the complete spring unit, the strings of coiled wire 9 are fed from a plurality of such storage reels 10 via channels 11 defined between dividers 12 to a spring unit assembly machine 13 where the strings 9 are interconnected to form the finished spring unit. In an alternative embodiment, sets of folded coils 9 exiting a plurality of folding tables 8 may be fed directly to the spring unit assembly machine 13 via channels 11.

The assembly machine 13 advances the strings 9 in parallel such that the coils 14 are aligned. The strings 9 are indexed by one coil width at a time to a set of transversely extending jaws 15 between which they are clamped. Successive coils 14 in the adjacent strings 9 are clamped with their longitudinal axes substantially upright. The jaws 15 effectively form a continuous helical channel into which a helical binding wire 16 is advanced. The binding wire is formed by passing uncoiled wire 17 from a reel 18 to a coiling passage 19 located to the side of the jaws 15 of the assembly machine 13. It is rotated and axially advanced in the transverse direction of arrow B through the jaws 15 such that is passes around the wire of the adjacent strings 9 and so as to form a row 20 of bound coils 14. The jaws 15 are then opened and the joined strings of coils 9 indexed forward in the direction of arrow A so as to locate the next coil of each string 9 within the jaws 15 whereupon the above cycle is repeated to bind the next row of coils together. The binding cycle is repeated a sufficient number of times to bind a suitable number of rows of coils together to produce a spring unit of the desired size.

One example of a method for manufacturing the strings of coils prior to the assembly machine is described in U.S. Pat. No. 5,105,642. This method is unduly complex particularly as it includes an additional folding station between the coiler and a coil interlock station. There is no detailed description of interlocking method. A problem with a coiler of this kind is that adjustment of the coil pitch is not possible without significant changes to the relative positions of the machine components.

An example of a conventional process for interlinking adjacent left and right handed coils comprises passing the coiled wire to a linking table whereupon a straight section of the wire interposed between the coiled sections is presented to a pivotable butterfly clamp which is located centrally with respect to the table. The straight section of the wire is then held in place by the butterfly clamp with the left and right handed coiled sections to either side. One of the coiled sections is then engaged by a 'pecker arm' which moves transverse to the longitudinal axis of the table to engage the coil and hold it in place relative to the linking table. A folding arm mounted above the table surface is then operated to pivot about a substantially upright support member and engage the free coiled section of wire on the opposite side of the butterfly clamp. Pivoting of the folding arm draws the free coiled section in an arc around the butterfly clamp towards the other coiled section which is held by the 'pecker arm' to interlink the two coiled sections of wire.

The process is unduly complex and requires extremely accurate control of a number of different simultaneous actions. Due to the complicated manner in which adjacent coils are interlinked, the operational efficiency of the process is severely restricted. For example, a process of this kind could typically interlink only 30 to 35 coils per minute. The apparatus required to carry out the process incorporates a number of different cammed surfaces to accurately control the movement of the various components. A problem with linking tables of this kind is that adjustment of the various components to accommodate coils of different sizes is not possible without significant changes to the relative positions of the machine components and the complicated nature of the apparatus results in reliability problems.

An example of an assembly machine is described in EP0248661. The disadvantage of this machine is that each of the pairs of jaws are opened and closed by a respective double acting pneumatic piston. Such a piston has at least one sensor so that the opening and closing of the jaws can be monitored. In operation it has been found that the machine operation is often interrupted through the malfunction of at least one sensor. The use of so many sensors increases the scope for interruption of the machine operation. Moreover, since the piston stroke time (and therefore the time required to open and close a pair of jaws) varies between pistons a sufficient time window has to be built into the timing cycle of the assembly operation in order to be sure that all of the jaws have opened or closed.

SUMMARY OF THE INVENTION

One aspect of the present invention relates to the first stage of the above manufacturing process, that is the formation of the coil springs from continuous wire.

Further aspects of the present invention relate to the second stage of the above manufacturing process, that is linking of adjacent coils of the coiled wire 4 on the coil linking table 8 to ensure that adjacent left and right-handed coils 5, 6 are linked together in the correct orientation for the final assembly stage.

A further aspect of the present invention is directed to an assembly machine for use in the third stage of the above process.

It is an object of the various aspects of the present invention to obviate or mitigate the aforesaid, and other, disadvantages.

According to a first aspect of the present invention there is provided coil formation apparatus for manufacturing spring coils from continuous wire, the coils being arranged to be of alternating hands along the wire, the apparatus comprising a coil forming device and means for feeding the wire to the device, the device comprising a pivotally disposed body providing support for a coil radius forming wheel against which the wire bears to form an arcuate shape and a guide member defining an opening from which the coiled wire emerges, the guide member being pivotally disposed relative to the body such that it can pivot between a first position where the opening is aligned with the wire emerging from the roller so that it passes therethrough without further deformation and at least one second position where it is misaligned and bears against the wire thus imparting the deformation to the wire that gives the coil its axial pitch, the angle of pivotal movement of the guide member being controlled by an adjustable drive mechanism that comprises a rotary drive shaft driven by a servomotor in response to instructions sent by a controller, the drive shaft being connected to the guide member by a transmission linkage that converts rotary movement of the drive shaft into translational movement of a link member and converts the translational movement of the link member to pivotal movement of the guide member as the main body is pivoted, the link member comprising a connecting rod connected to a radius arm of the drive shaft by means of an adjustable connection.

Preferably the guide member is pivotal between two second positions, one to each side of the first position.

It is preferred that the adjustable connection comprises an arm to which an end of the connecting rod is pivotally connected, the position of the end of the connecting rod being adjustable by an adjustment element. The adjustment element may be a screw or the like that is rotatable in one direction to bear against the end of the connecting rod and move it radially closer to the centre of rotation of the drive shaft. Conveniently, the arm has a slot, and a fixing member passes through the end of the connecting rod and the slot so as to connect the connecting rod to the arm, the adjustment element being adapted to move the end of the rod along the slot. Preferably the adjustment element bears against the fixing member.

In a preferred embodiment the transmission linkage comprises a sliding yoke that is connected to the connecting rod and slides along a shaft on which the body is mounted for pivotal movement.

It is particularly preferred that the translational movement of the link member is converted into pivotal movement of the guide member by a cam and cam follower comprising a bar with a spiral cam groove in which a pin is received, the axial movement of the bar being restrained such that movement of the pin relative to the bar along the cam groove causes rotation of the bar and therefore pivoting movement of the guide member.

According to a second aspect of the present invention there is provided a coil interlinking process for interlinking first and second wire coils defining respective first and second coil axes, the process comprises providing the first and second coils on a supporting surface such that the first and second coil axes are orientated substantially perpendicular to a longitudinal axis of the supporting surface, actuating a first compression member to compress the first coil substantially parallel to said first coil axis to define a first clearance between the first coil and a first edge of the supporting surface, actuating a first indexing member to extend the second coil substantially parallel to said longitudinal axis passed the first coil via said first clearance, retracting the first compression member to allow the first coil to extend substantially parallel to the first coil axis across said first clearance, and retracting the first indexing member to allow the second coil to contract substantially parallel to said longitudinal axis such that the second coil engages the first coil thereby interlinking the first and second coils.

A significant advantage provided by this process is that the various steps required to interlink adjacent coils can be achieved in a stepwise fashion using simple sequential linear movements of the compression member and the indexing member. It is therefore no longer necessary to coordinate simultaneously a number of different more complex movements to interlink a pair of spring coils. The timing of the various steps involved in the inventive process is consequently much easier to control than in prior art systems. This fact, together with the removal of the need to pivot one coil with respect to the other coil to interlink them significantly increases the throughput of the interlinking operation. It has been observed that the operational efficiency of the interlinking operation can be doubled by use of the inventive process.

Preferably prior to actuation of the compression member a retaining pin is extended substantially perpendicular to the supporting surface to engage a portion of the first coil and retain the first coil in a substantially fixed longitudinal position in relation the supporting surface during compression of the first coil with the first compression member.

It is preferred that after interlinking of the first and second coils said retaining pin is retracted so as to no longer engage said portion of the first coil and indexing apparatus subsequently actuated to advance the interlinked first and second coils a predetermined distance substantially parallel to said longitudinal axis.

Conveniently the process further comprises actuating a second compression member to compress the first coil substantially parallel to said first coil axis to define a second clearance between the first coil and a second edge of the supporting surface which is opposite to said first edge, the second compression member being actuated sequentially or simultaneously with the first compression member.

After interlinking the first and second coils, the interlinked first and second coils may be heat treated. Preferably said heat treatment is carried out by passing an electric current through the first and second interlinked coils.

In a preferred embodiment of this aspect of the present invention said first and second coils are formed in a single piece of wire and most preferably said first coil is a right handed coil and said second coil is a left handed coil.

A third aspect of the present invention provides coil interlinking apparatus for interlinking first and second wire coils defining respective first and second coil axes, the apparatus comprising a supporting surface, a first compression member and a first indexing member, the supporting surface being arranged to enable the first and second coils to be provided on the supporting surface such that their first and second coil axes are orientated substantially perpendicular to a longitudinal axis of the supporting surface, the first compression member being operable to compress the first coil substantially parallel to said first coil axis to define a first clearance, the first indexing member being operable to extend the second coil substantially parallel to said longitudinal axis passed the first coil via said first clearance, the first compression member being operable to retract to allow the first coil to extend substantially parallel to the first coil axis across said first clearance, and the first indexing member being operable to allow the second coil to contract substantially parallel to said longitudinal axis such that, in use, the second coil engages the first coil thereby interlinking the first and second coils.

Preferably the supporting surface additionally comprises a second edge opposite to said first edge, and first and second side walls are provided at said first and second edges respectively, the side walls and the supporting surface together defining a channel.

In a preferred embodiment the first side wall defines a first slot extending substantially parallel to said longitudinal axis of the supporting surface, the slot being configured for receipt of a base portion of the first indexing member.

The first indexing member may comprise a coil engaging portion connected to said base portion, said coil engaging portion projecting into said channel. Conveniently the coil engaging portion of the first indexing member has an arcuate leading surface. Preferably the coil engaging portion of the first indexing member has a ramped trailing surface.

In a further preferred embodiment the support surface defines a first guide slot extending substantially perpendicular to said longitudinal axis of the supporting surface for receipt of the first compression member. The first compression member preferably has an inclined leading edge.

It is preferred that the apparatus further comprises a retaining pin which is operable to extend substantially perpendicular to the supporting surface to engage a portion of the first coil and retain the first coil in a substantially fixed longitudinal position in relation the supporting surface during compression of the first coil with the first compression member.

The apparatus may further comprise indexing apparatus operable to advance the interlinked first and second coils a predetermined distance substantially parallel to said longitudinal axis.

Conveniently heat treatment means may be provided to heat treat the interlinked first and second coils and said heat treatment means preferably comprises a pair of electrodes configured to pass an electric current through the first and second interlinked coils.

A fourth aspect of the present invention provides apparatus for manufacturing a spring unit for a mattress or the like, the spring unit comprising a plurality of strings of spring coils, each string arranged so that the coils are disposed in a row in a side by side relationship, the apparatus comprising an inlet unit to which the strings of coils are fed, an indexing device and a binding station by which the plurality of strings are bound together by a helical binding wire, the binding station comprising at least one pair of jaws movable between open and closed positions, the jaws combining in said closed position to define a helical passage through which the helical binding wire is direction so as to bind adjacent strings of coils together, the jaw pairs each comprising a first fixed jaw and a pivotal second jaw, the pivotal second jaw being pivoted by a cam and linkage assembly that is operated by a rotary drive shaft.

Preferably the cam is an eccentric cam.

Preferably there are a plurality of jaw pairs arranged side by side, each pair having its own eccentric cam and linkage assembly, the assemblies being operated by a common rotary drive shaft.

In a preferred embodiment of this aspect of the present invention the linkage assembly comprises a lever arm that is pivotally mounted in a support and is pivotally moveable by the eccentric cam, the lever arm being connected to the pivotal second jaw. The lever arm may be connected to a pivoting arm via a link member, the pivotal second jaw being mounted on the pivoting arm. Conveniently, the jaws may be mounted in a body, the lever arm and pivoting arm being pivotally mounted to the body. The lever arm and pivoting arm are preferably pivotally mounted on shafts supported by the body, and it is preferred that the body has a pair of spaced side walls and the lever arm is pivotally disposed between the side walls.

The rotary drive shaft is preferably driven by a servomotor, which may be connected to the drive shaft via a torque limiter device. Conveniently, the torque limiter device is provided in a gearbox.

It is particularly preferred that the jaw pairs are arranged into two sets to enable simultaneous binding of opposite sides of the spring unit.

The jaws may be mounted in the apparatus on a support that is moveable by an actuator.

It will be appreciated that the various apparatus and methods described in this summary section, as well as elsewhere in this application, can be expressed as a large number of different combinations and subcombinations. All such useful, novel, and inventive combinations and subcombinations are contemplated herein, it being recognized that the explicit expression of each of these myriad combinations is excessive and unnecessary.

These and other features and aspects of different embodiments of the present invention will be apparent from the claims, specification, and drawings. Although various specific quantities (spatial dimensions, material, temperatures, times, force, resistance, etc.), such specific quantities are presented as examples only, and are not to be construed as limiting.

DESCRIPTION OF THE PREFERRED EMBODIMENT

Figure 1:
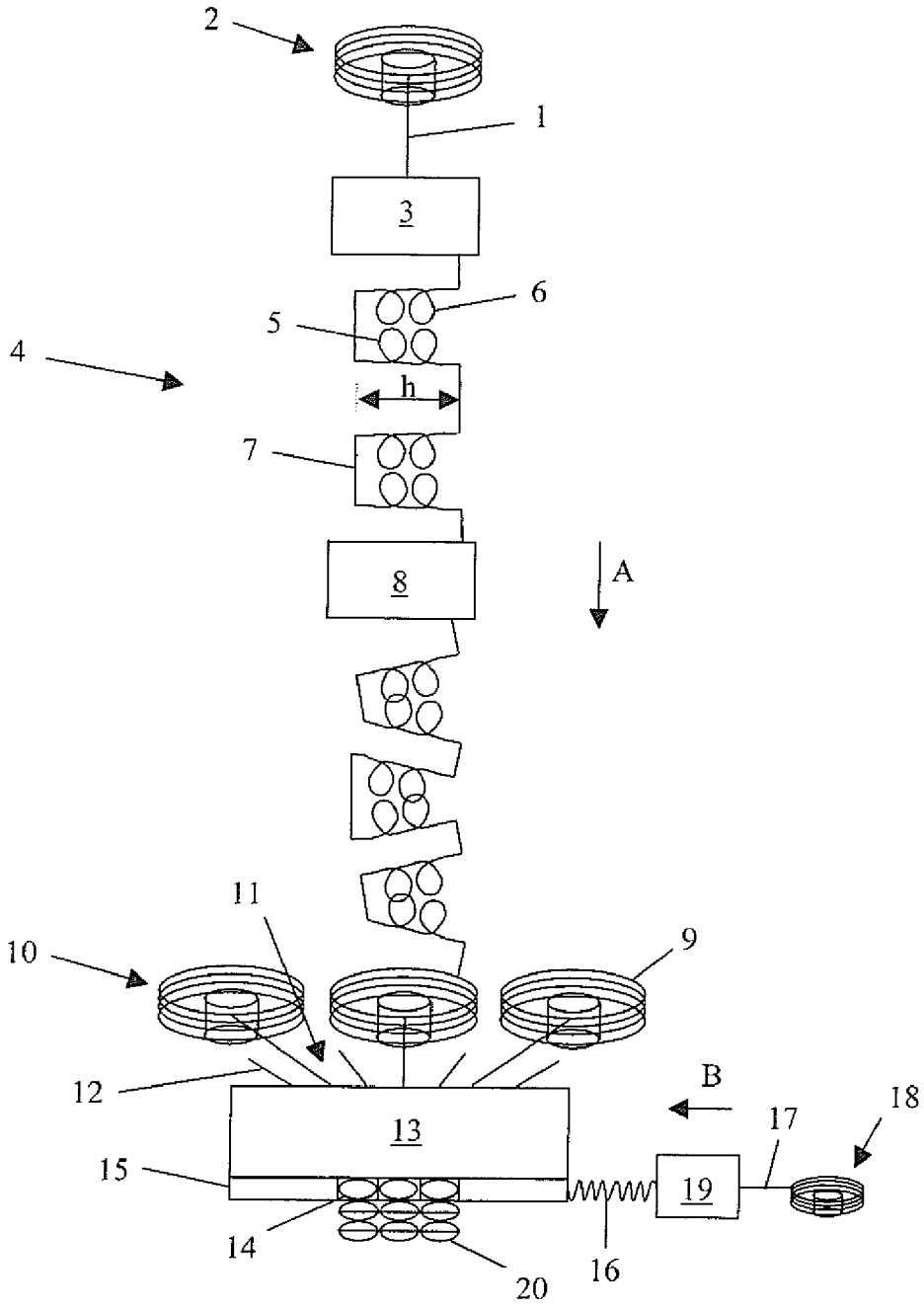
Fig. 1 PRIOR ART
FIG. 1 is a schematic representation in plan view of a conventional spring unit production process showing the manufacturing stages that are also adopted in the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIGS. 1 to 4, for the sake of simplicity only one spring coiling machine is shown in the figures. However, it is to be understood that two or more machines may be arranged in parallel. In such an arrangement all the coiling machines are identical and driven by a common drive mechanism such that they operate synchronously.

Each coiling machine 3 comprises an inlet wire feeder (hidden) that takes wire 1 continuously from the reel 2 and advances it in a direction along the longitudinal axis of the wire to a coiling head 30 that forms the wire into the helical coils 5, 6. The radius of the coils 5, 6 and their pitch (i.e. the axial distance between identical points on adjacent loops of a coil) is governed by the operation of the coiling head 30.

Figure 2:
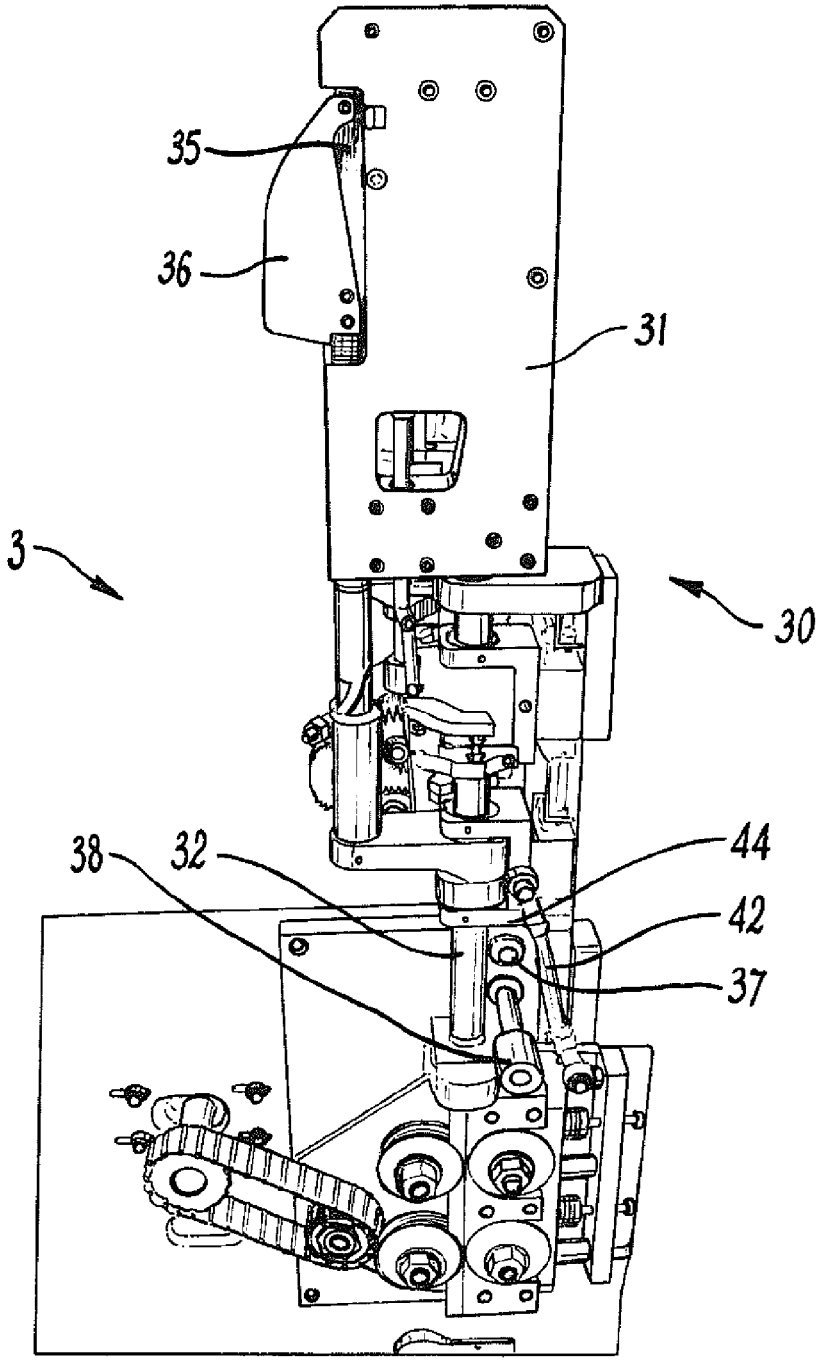
FIG. 2 is a perspective view from one side of a coiling machine in accordance with one aspect of the present invention.
Figure 3:
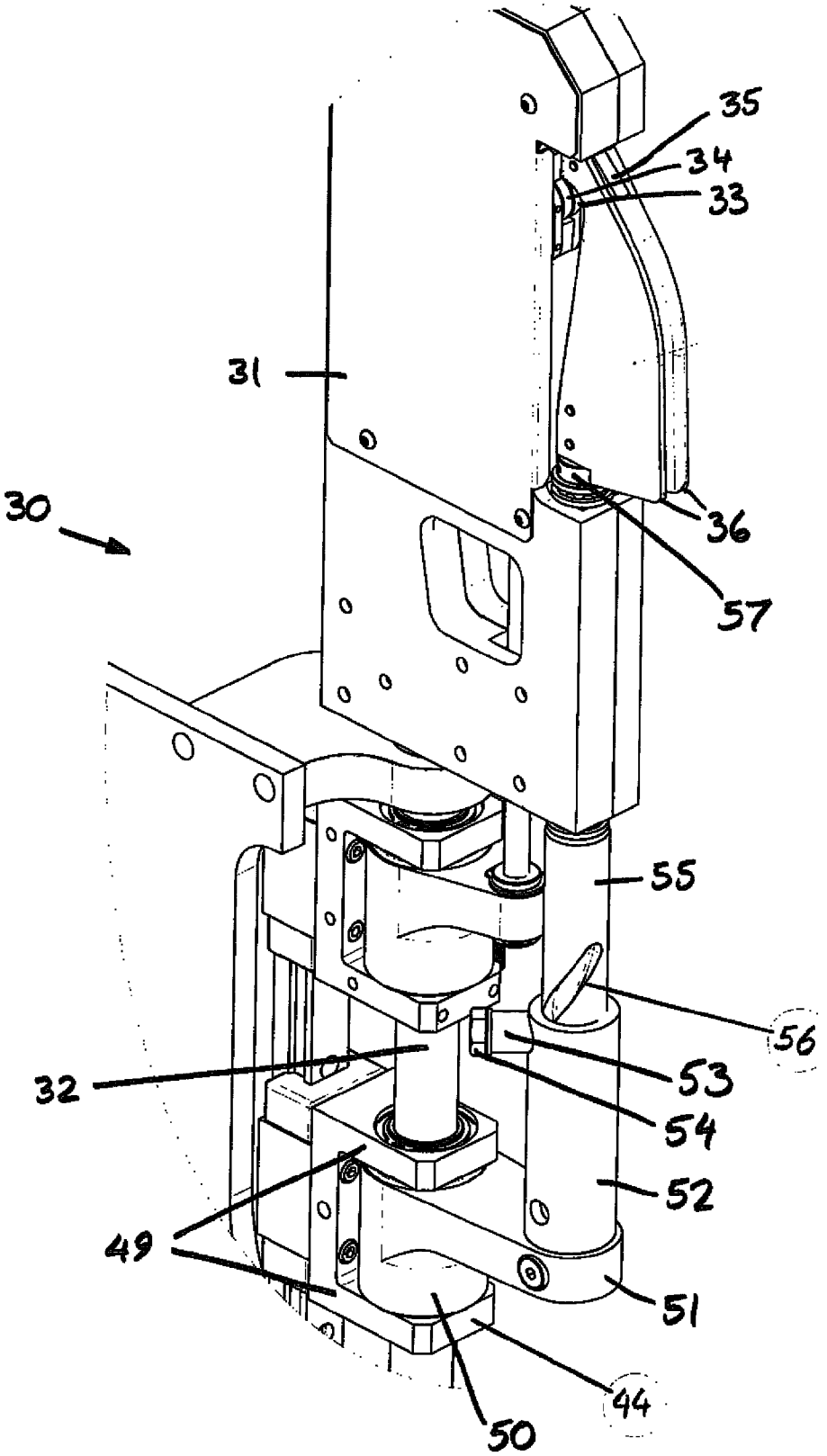
FIG. 3 is a perspective view from the side of an upper part of the coiling machine.
Figure 4:
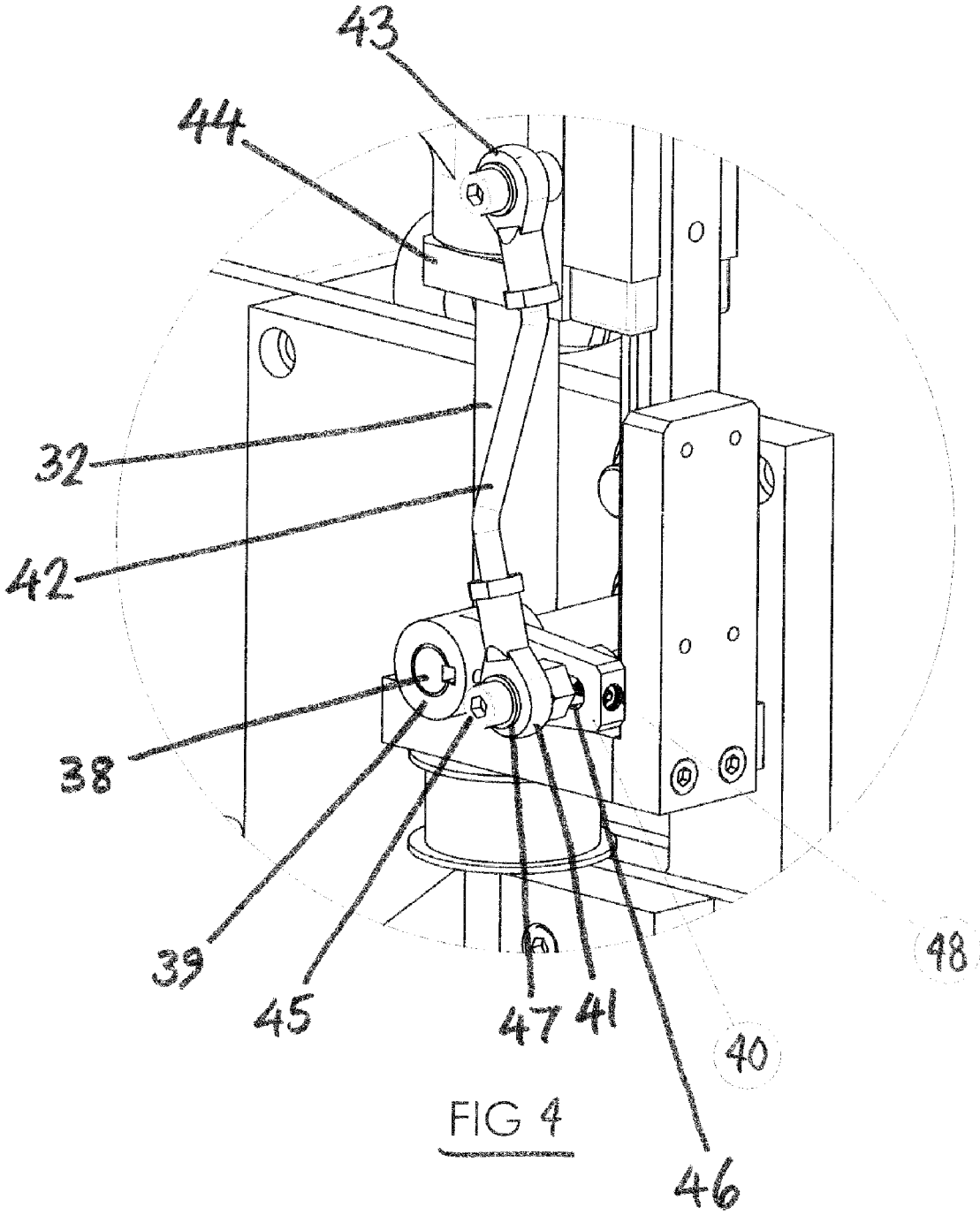
FIG. 4 is an inset view of part of the coiling machine showing a coil pitch adjustment feature in accordance with one aspect of the present invention.

The head 30 comprises a main body 31 of generally rectangular outline that is fixed on a vertical rotary shaft 32 and supports a forming roller 33 that is disposed in the path of the incoming wire 1 (not shown in FIGS. 2 to 4). The roller has a peripheral groove 34 in which the wire is received and serves to deflect the wire, as it egresses from the main body 31, into an arcuate form. The main body has a cut out recess 35 that pivotally supports a pair of parallel spaced guide plates 36 between which the arcuate wire passes. The recess 35 is sized in a vertical direction so as to prevent the plates 36 from moving vertically relative to the main body 31. The axial dimension of the spring coils 5, 6 is imparted by pivoting movement of the guide plates 36 relative to the main body 35. The angle that the guide plates 36 subtend to the plane occupied by the main body 35 determines the pitch of the coil 5,6 and therefore the height h of each spring coil. When the guide plates 36 are substantially aligned with the plane of the main body 35 this represents the datum position and the wire is not deflected in axial direction (of the coils). If the plates 36 are disposed at a negative angle to the datum position the wire is deformed into a left hand coil, whereas if they are at a positive angle the wire is deformed into a right hand coil. In operation the plates 36, are driven to pivot according to a complex algorithm so as to define the pitch of the coil 5,6 at any one time. At the same time the position of the roller 33 relative to the wire 1 can be varied by a known mechanism so as to set the radius of the emerging coil of the wire at any point in time. For example, in between the left and right hand coils 5, 6 the straight length of wire 7 is produced by virtue of the roller 33 being spaced from the wire and therefore not imparting any deflecting force thereon. It will thus be appreciated that the shape of any given coil 5, 6 is determined by the relative movement of the guide plates 36 and the roller 33 with respect to the main body 31 of the coiling head 30.

The various movements of the components of the coiling head 30 are controlled by linkages that are driven by rotary drive shafts 37 38, which, in turn, are driven by computer-controlled servomotors (not shown). A control computer or processor (not shown) executes a software instruction set to govern the rotation of the output shafts of the servomotors and this is translated into the fine control of the movements of the drive shafts 37, 38 by reduction gearboxes (not shown).

A known drive mechanism operates to rotate the rotary vertical shaft 32 and the main body 31 through a limited angle of typically 180 degrees or less between first and second limit positions. This arrangement is known and is designed to prevent entanglement of the continuous string of coils as the coiler head 30 produces alternate left hand and right hand coils 5, 6.

The rotation of a first drive shaft 37 common to both the coiling heads is used to control the position of the roller 33 so as to control the size of radius applied to the wire 1 in a known manner.

The pivoting movement of the guide plates 36 relative to the main body 31 of the coiling head 30 is governed by rotation of a second drive shaft 38 by a servomotor (via a reduction gearbox) operating in accordance with a software program executed on the control computer or processor.

The present invention is concerned with the linkage between the second drive shaft 38 and the guide plates 36 and, in particular, its adjustable nature.

Referring to FIG. 2, a collar 39 is fixed to one end of the second drive shaft 38 and has a radially extending crank arm 40 that supports a first end 41 of a connecting rod 42. The other end 43 of the connecting rod 42 is fixed to a yoke 44 that is slidably mounted on the vertical shaft 32 on which the main body 31 of the coiling head 30 is supported. The connecting rod 42 is pivotally connected to the crank arm 40 by means of a captive screw 45. The crank arm 40 has an elongate slot 46 defined along its length and the first end 41 of the connecting rod 42 has an eyelet 47 whose centre is aligned with the slot 46 so that the captive screw 45 passes through both. The arrangement is such that the eyelet 47 is free to rotate on the shank of the captive screw 45. An adjustment screw 48 is disposed in a threaded bore extending from the free end of the crank arm 40 and projects into the slot 46 so as to contact the shank of the captive screw 45, the longitudinal axis of the adjustment screw 48 extending substantially perpendicularly to the corresponding axis of the captive screw 45. The arms 49 of the yoke 44 embrace a sleeve 50 that is slidably supported on the vertical shaft 32 such that it can move up and down the shaft with the yoke 44. The sleeve 50 has a radially extending arm 51 on which a cylindrical socket 52 is supported such that its longitudinal axis extends substantially parallel to the axis of the rotary vertical shaft 32. The socket 32 has a main wall with an internally threaded boss 53 that extends in a direction substantially perpendicular to the longitudinal axis of the socket and supports a threaded bolt 54. A cylindrical barrel cam 55 with a spiral cam groove 56 defined in its outer surface is received in the socket 32 with the bolt 54, which serves as the cam follower, extending into the spiral cam groove 56. The barrel cam 55 has an extension 57 that extends into the main body 31 of the coiling head 30 and its end distal to the socket 32 is connected to the bottom of the guide plates 36. The cam extension 57 is rotatably disposed in the main body 31 and, in use, effects rotation of the guide plates 36 in response to rotational movement of the drive shaft 38 as will now be explained.

The reduction gearbox ensures that the extent of angular rotation of the drive shaft 38 is limited to less than around 90 degrees. The rotational movement of the drive shaft 38 is converted into translational vertical movement of the yoke 44 and sleeve 50 by virtue of the crank arm 40 and connecting rod 42. The crank arm 40 rotates with the drive shaft and 38 carries with it the pivoting end 41 of the connecting rod 42. The position of the end 41 of the connecting rod 32 along the length of the slot 46 defines the effective radius of the crank arm 40 that governs the length of travel of the yoke 44. This translational movement is passed to the socket 52 and cam follower bolt 54 and is converted into rotation of the guide plates 36 by virtue of the engagement of the bolt 54 with the walls of the spiral groove 56 defined in the surface of the barrel cam 55 and the fact that the guide plates 36 and cam 56 are prevented from vertical movement relative to the main body 31 of the coiling head 30.

Adjustment to the coil pitch is achieved by loosening the captive screw 45 and turning the adjustment screw 48. If the screw 48 is turned counterclockwise it pushes the captive screw 45 to the left (as shown in FIG. 4) so as move the connection point and shorten the effective length of the crank arm 40. This reduces the radius which the connecting rod 42 is orbits the drive shaft 38 and thus shortens the extent of its vertical travel and therefore the distance through which the yoke 44, sleeve 50 and socket 32 travel. The effect of this is that the relative movement of the cam follower 54 in the spiral cam groove 56 is restricted so as to limit the amount of rotation of the barrel cam 55 and the guide plates 56. If the adjustment screw 48 is turned in the opposite direction the crank arm 40 of the connecting rod 42 is increased so as to increase the angle of sweep of the guide plates 36 and thus increase the pitch of the coils. This adjustment feature provides for a quick and easy means for changing screw pitch rather than having to make changes to data used by the software.

Figure 5:
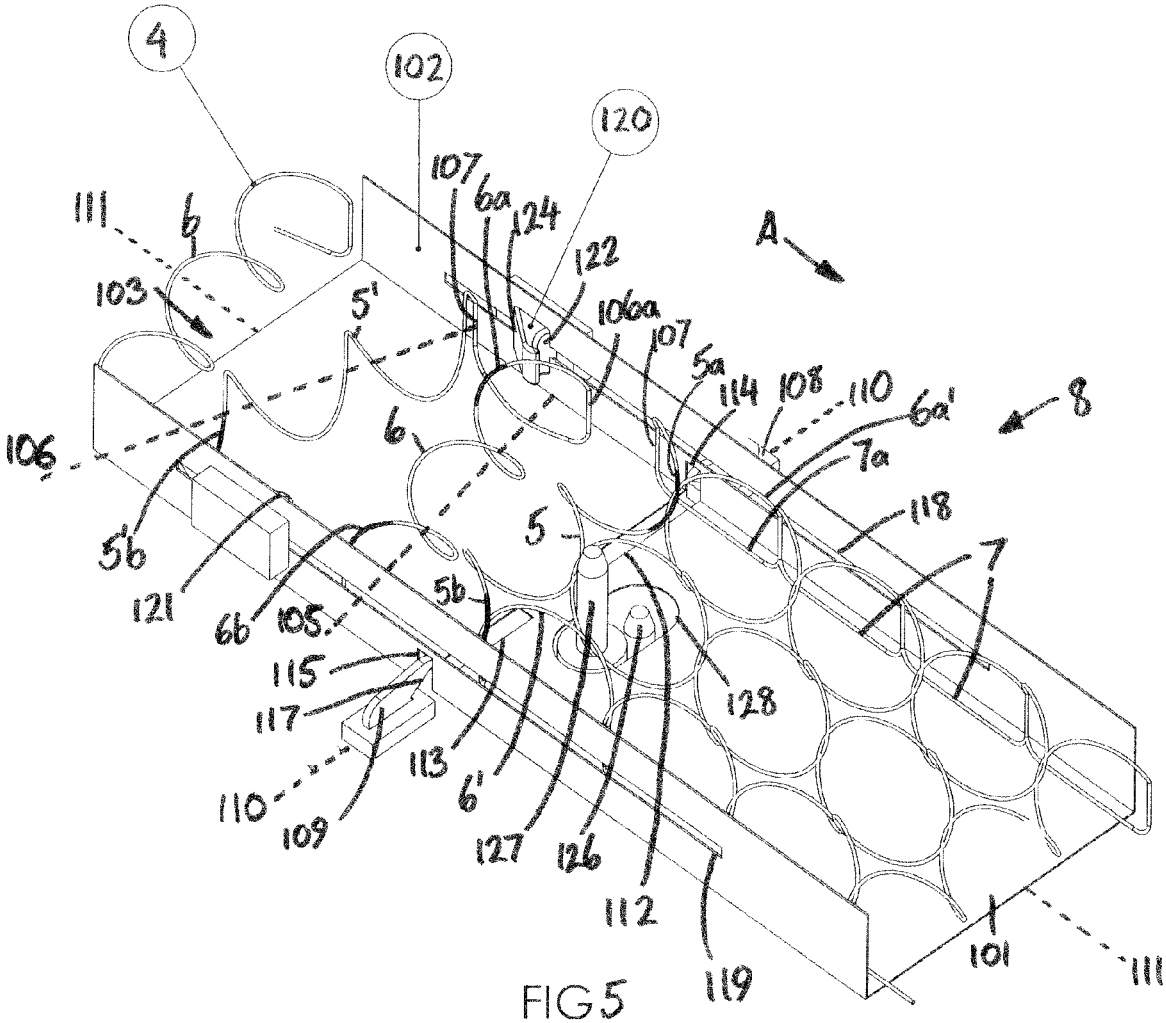
FIG. 5 is a perspective schematic overview of a linking table in accordance with an aspect of the present invention shown with a partly linked helical wire coil at a first step in a linking operation.

Referring now to FIG. 5, the coil linking table 8 comprises a supporting surface 101 and a pair of upwardly extending side walls 102 which together with the surface 101 define a linking channel 103 along which the wire coil 4 is fed during a linking operation in the direction of arrow A. The continuous wire coil 4 has been processed using the coiling machine 3 (shown in FIGS. 1 to 4) to provide the coil 4 with alternately left and right handed coiled sections 5, 6, each coiled section defining a respective central longitudinal coil axis 104, 105 along which each coil is designed to be compressed in normal use. The coiling machine 3 is located an adequate distance upstream of the linking table 8 to ensure the wire coil 4 has relaxed to a sufficient degree to enable the linking operation to be carried out. The coils 5, 6 are interposed by longer straight (i.e. uncoiled) sections of wire 7. Each coiled section 5, 6 is connected to adjacent longer straight sections 7 by two shorter straight sections of wire 106, 107, one of which is provided at each end of the coiled section 5, 6. The shorter straight sections of wire 106, 107 are orientated at approximately 90° to the neighbouring longer straight sections of wire 7 to which they are connected.

The linking apparatus further comprises a pair of compression fingers 108, 109 which are pneumatically actuated so as to be linearly moveable along a transverse axis 110 with respect to the longitudinal axis 111 of the linking channel 103. A pair of slots 112, 113 extending along transverse axis 110 are defined in the supporting table 101 and connect with a pair of upwardly extending slots 114, 115 defined in the side walls 102. The slots in the table 112, 113 and side walls 114, 115 are provided to facilitate movement of the compression fingers 108, 109 along transverse axis 110 between a rest position outside of the linking channel 103 (as shown in FIG. 5) and an innermost clamping position within the linking channel 103 (as described below with reference to FIGS. 6 and 7). Each compression finger 108, 109 is provided with an upwardly sloping leading edge 116, 117 so that as each finger 108, 109 moves inwardly along transverse axis 110, the edge 116, 117 securely engages and inwardly compresses the longer straight section of wire 7 interposed between adjacent coils 5, 6.

A further feature of the linking table 8 is the provision of a longitudinally extending guide slot 118, 119 defined by each side wall 102. A pneumatically actuated indexing hook 120, 121 is slidably received in each guide 118, 119 and comprises an arcuate leading surface 122, 123 and a ramped trailing surface 124, 125 (only one of the two hooks 120, 121 can be seen in FIG. 5). Each arcuate leading surface 122, 123 is of slightly smaller height than the length of each shorter section of wire 106, 107 such that, when the wire coil 4 is properly arranged within the linking channel 103, downstream movement of each hook 120, 121 along its guide 118, 119 securely engages the next available shorter straight section of wire 106, 107 and advances the coil 4 in a downstream direction. Each hook 120, 121 is provided with a ramped trailing surface 124, 125 so that when each hook 120, 121 moves in an upstream direction the next upstream shorter straight section of wire 106, 107 passes up and over the ramped surface 124, 125 of each hook 120, 121 without being appreciably compressed or moved upstream.

Another feature of the linking table 8 is a pair of pneumatically actuated retaining pins 126, 127 which are alternately moveable in an upright direction into and out of the linking channel 103 via an aperture 128 defined by the linking table 8. Each pin 126, 127 is of greater height when fully extended upwards than the height of the coils 5, 6 when lying on the table surface 101. The purpose of the pins 126, 127 is to ensure that the sections of the wire coil 4 to be linked (as described below) are retained in the correct position to be engaged and compressed by the fingers 108, 109.

Figure 6:
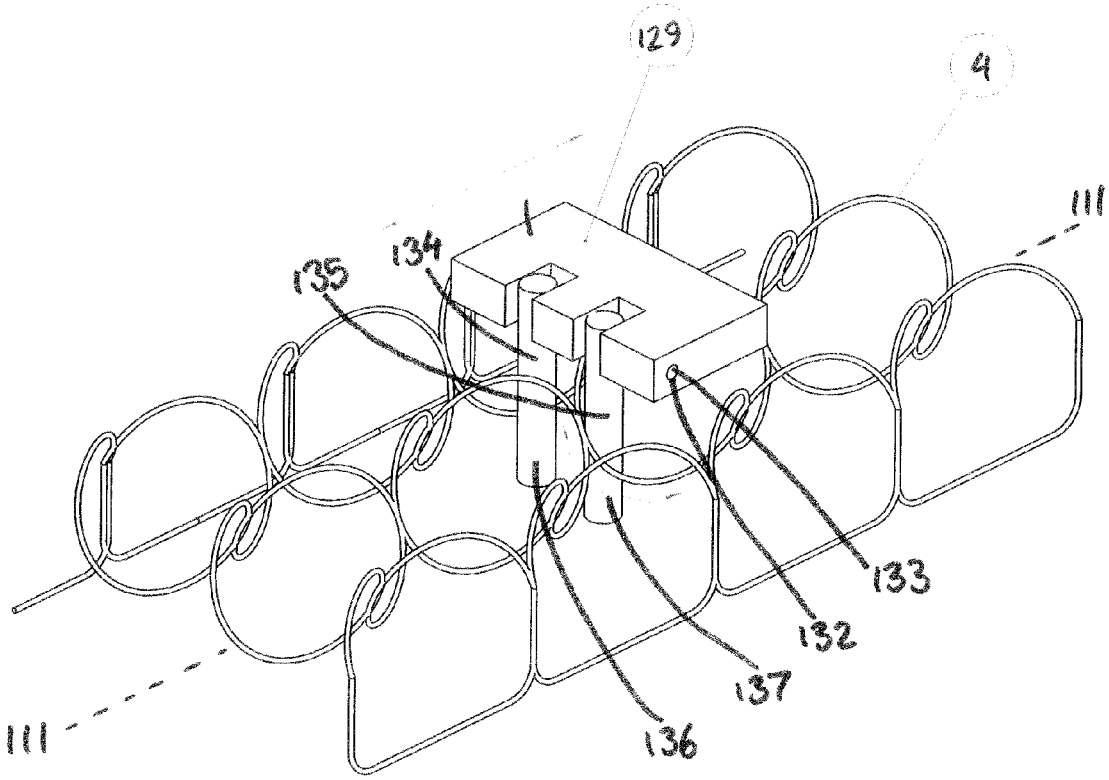
FIG. 6 is a perspective schematic view of a pair of indexing fingers used to index the helical wire coil of FIG. 5 across the linking table.

The linking table 8 further comprises a pneumatically actuated ratchet indexer 129 shown in FIG. 6 together with a section of linked wire coil 4. The ratchet indexer 129 is received in a longitudinally extending guide channel 130 (described in more detail in relation to FIG. 11) so as to be slidably moveable along the longitudinal axis 111 of the linking channel 103. The indexer is located downstream of the retaining pins 126, 127 shown in FIG. 5 and is provided to engage and index the wire coil 4 in a downstream direction along the linking channel 103.

The indexer 129 comprises a support 131 which defines a transverse aperture 132 for receipt of a pivot pin 133 upon which is rotatably mounted a pair of indexing fingers 134, 135. The fingers 134, 135 are mounted on the pin 133 such that they can only pivot between a retracted position in which the distal ends 136, 137 of the fingers 134, 135 are positioned adjacent to the support 131 (not shown in FIG. 6) and an extended position in which the distal ends 136, 137 of the fingers 134, 135 are furthest from the support 131 and the fingers 134, 135 extend downwardly (as shown in FIG. 6). In this way, when the indexer 129 is moved in an upstream direction and the fingers 134, 135 engage a section of the wire coil 4, the fingers 134, 135 pivot upwardly towards the support 131 and pass over that section of the wire coil 4. After passing over that section of the wire coil 4 the fingers 134, 135 then pivot downwardly to the extended position shown in FIG. 6. Subsequent downstream movement of indexer 129 then causes the fingers 134, 135 to engage a section of the wire coil 4 and, by virtue of the fingers 134, 135 being unable to rotate passed the downward direction shown in FIG. 6, the fingers 134, 135 advance the wire coil 4 in a downstream direction along the linking channel 103.

A funnel (not shown) is provided at the upstream end of the linking table 8 to direct the moving wire coil 4 into the linking channel 103 in the correct orientation for linking. Furthermore, a set of electrodes (not shown) is attached to the upright side walls 102 at the downstream end of the linking table 8 to heat treat the linked wire coil 4 as it exits the linking table 8. Heat treatment of coiled wire is known to enhance the resilience of the coils to compression. Two pairs of electrodes are provided with a pair of anodes on one side wall 102 and a pair of cathodes on the opposite side wall 102. Each electrode is provided with a conducting metal projection which is directed into the linking channel 103 so as to be contactable by coils as they pass the electrode. The electrodes are appropriately arranged to ensure that passage of a coil completes an electric circuit between an anode and a cathode which thereby heats the coil forming part of the circuit.

The overall aim of the linking operation is to interlink each coiled section of wire 5, 6 to the adjacent upstream and downstream coiled sections 5, 6 in such a way that the intervening longer straight sections of wire 7 are essentially parallel to one another, which correctly orientates the various coiled and uncoiled sections of wire 6 for binding to other separate strings of coiled wire in the final step of the spring unit assembly process. References to components of the linking table 8 and portions of the wire coil 4 as being on the left hand side or the right hand side are to be considered as if the table 8 is being viewed from its downstream end.

In the following example, a right hand portion 6*a* (shown shaded) of a right handed coil 6 is interlinked with a right hand portion 5*a* (shown shaded) of downstream left handed coil 5. To complete the linking operation, a left hand portion 6*b* (shown shaded) of the right handed coil 6 would then be interlinked to a left hand portion 5'*b* of an upstream left handed coil 5' by repeating the process described below but in the opposite fashion, i.e. by operating the opposite member of each pair of components (e.g. compression fingers 108, 110, retaining pins 126, 127, etc).

After the wire coil 4 exits the coiling machine 3 it is passed to the surface 101 of the linking table 8 whereupon it enters the linking channel 103. The wire coil 4 is then advanced in a downstream direction along the linking channel 103. In FIG. 5, a left hand section 5*b* of the wire 5 has already been linked to a left hand section of the next upstream coil 6' and the section 5*a* is about to be linked. The linking operation will be described beginning at this point.

Figure 7:
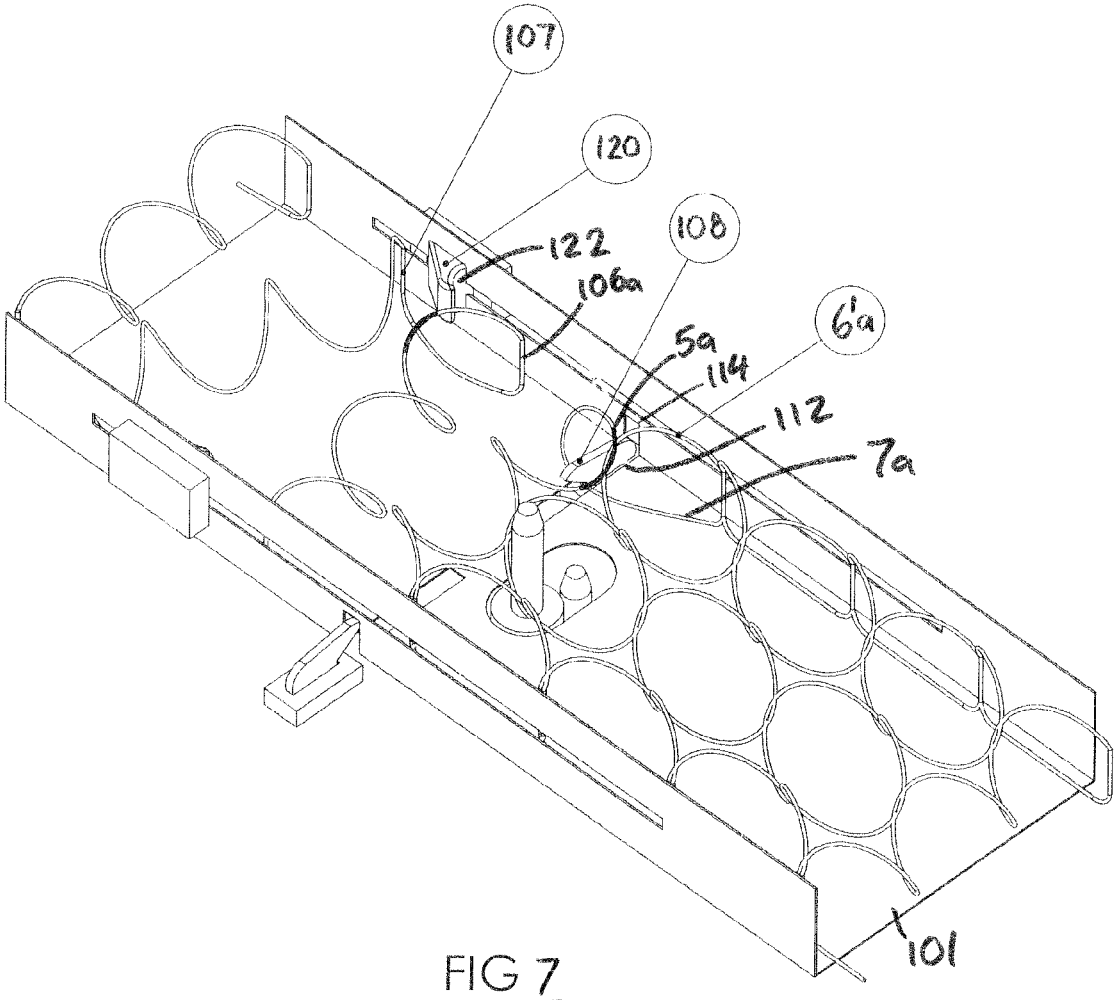
FIG. 7 is a perspective schematic overview of the linking table and the partly linked helical wire coil of FIG. 5 shown at a second step in the linking operation.

In FIG. 5 both compression fingers 108, 109 are at the rest position clear of the linking channel 103 to enable the coil portion 5*a* to be advanced downstream into the correct starting position as shown. The left hand retaining pin 127 is currently extended and the right hand retaining pin 126 is retracted. The next step, shown in FIG. 7, is to actuate the right hand compression member 108 to slide inwardly through the slots 112 and 114 such that its sloping leading edge 116 engages a longer straight section 7*a* of wire interposed between coil portion 5*a* and a right hand portion 6'*a* of a downstream right handed coil 6'. Inward movement of the compression finger 108 towards its innermost clamping position compresses the straight section 7*a* inwardly away from the side wall 102 which in turn draws the coil portion 5*a* inwards and slightly downwards towards the linking table surface 101. In an alternative embodiment not shown in the accompanying figures, both compression fingers 108, 109 can be actuated to slide inwards simultaneously to engage and compress longer straight sections 7 of the wire 4 located to both the right and left hand sides of the wire 4 at the same time. Regardless of whether the compression fingers 108, 109 are actuated sequentially or simultaneously, the remaining steps in the interlinking operation are the same.

Figure 8:
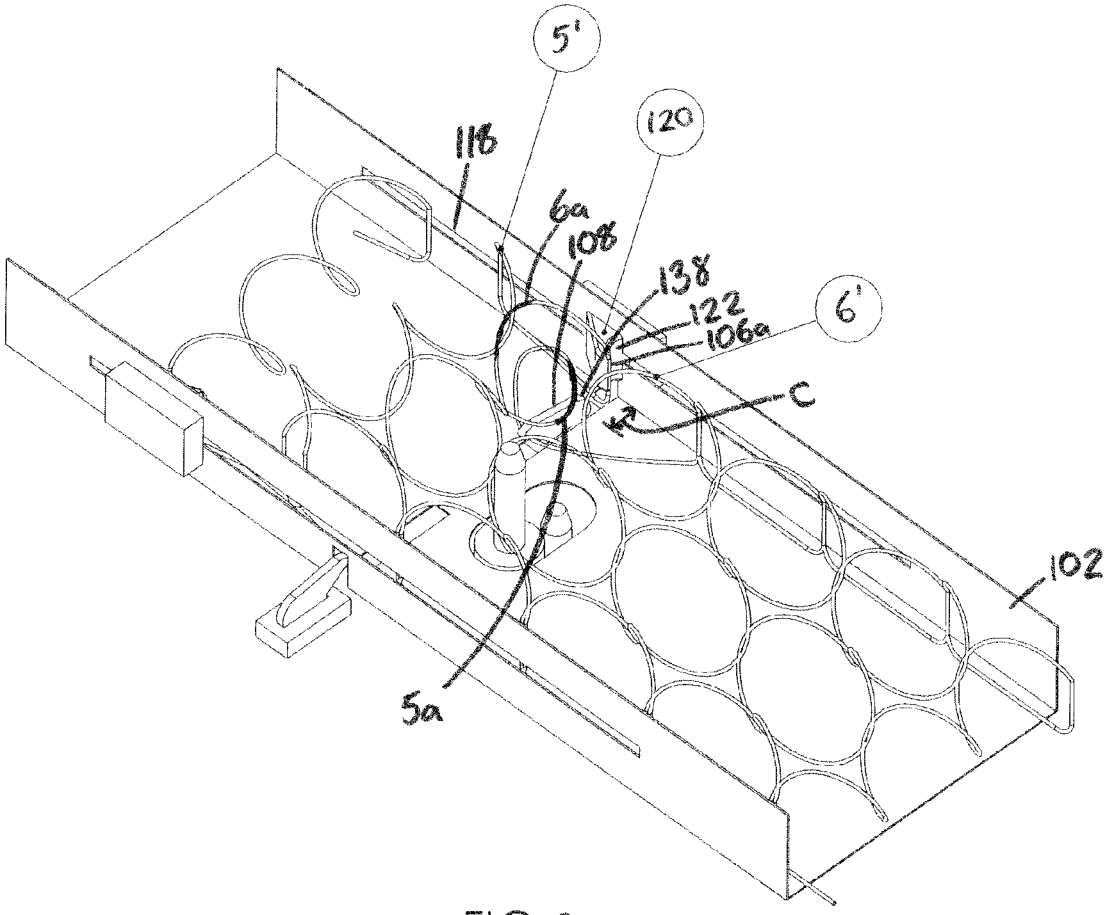
FIG. 8 is a perspective schematic overview of the linking table and the partly linked helical wire coil of FIG. 5 shown at a third step in the linking operation.

As shown in FIG. 8, the compression finger 108 is actuated to slide a sufficient distance inwards so that when at its innermost clamping position, a clearance c is defined between a rear end 138 of the compression member 108 and the side wall 102. The hook 120 is then actuated to slide along the guide 118 in a downstream direction such that its arcuate leading surface 122 engages the shorter straight section of the wire 106*a* which is connected to the coil portion 6*a*. The clearance c defined between the rear end 138 of the compression finger 108 and the side wall 102 is sufficiently large to enable the hook 120 carrying the straight wire section 106*a* to pass through the clearance c such that coil portion 6*a* is extended and finally located downstream of coil portion 5*a* (not shown).

Figure 9:
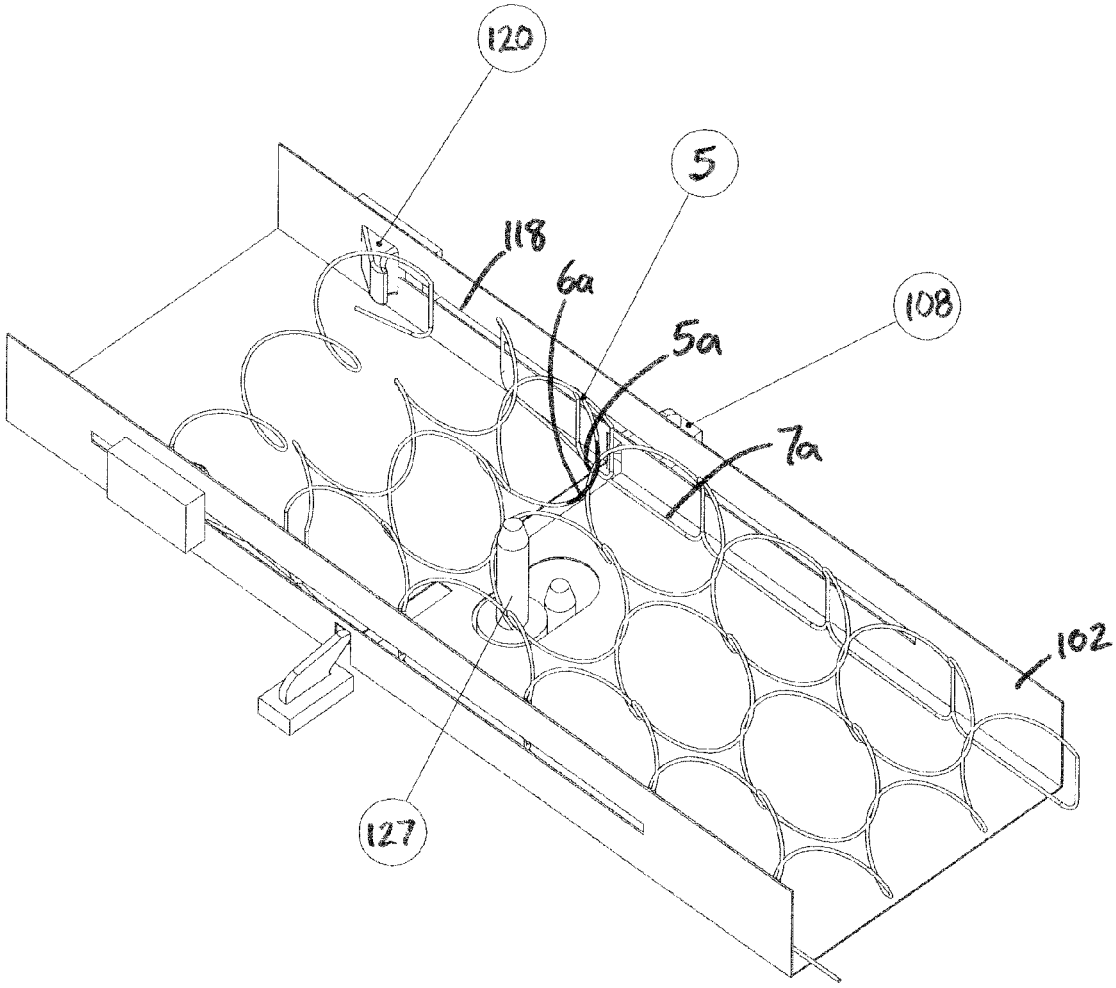
FIG. 9 is a perspective schematic overview of the linking table and the partly linked helical wire coil of FIG. 5 shown at a fourth step in the linking operation.

With reference to FIG. 9, the compression finger 108 is then actuated to slide outwards and return to its rest position. In doing so, the straight section 7*a* extends outwardly towards the side wall 102 and the coil portion 5*a* extends outwards across the clearance c and upwards back to its initial position as in FIG. 5. The right hand hook 120 is then actuated to slide upstream along the guide 118 thereby gradually releasing the coil portion 6*a* and allowing it to contract and move back upstream until it engages the coil portion 5*a* whereupon the coil portions 5*a* and 6*a* become interlinked with the coil portion 6*a* lying to the downstream side of the coil portion 5*a*. Continued upstream movement of the hook 120 returns it to its initial starting position as shown in FIG. 8.

Figure 10:
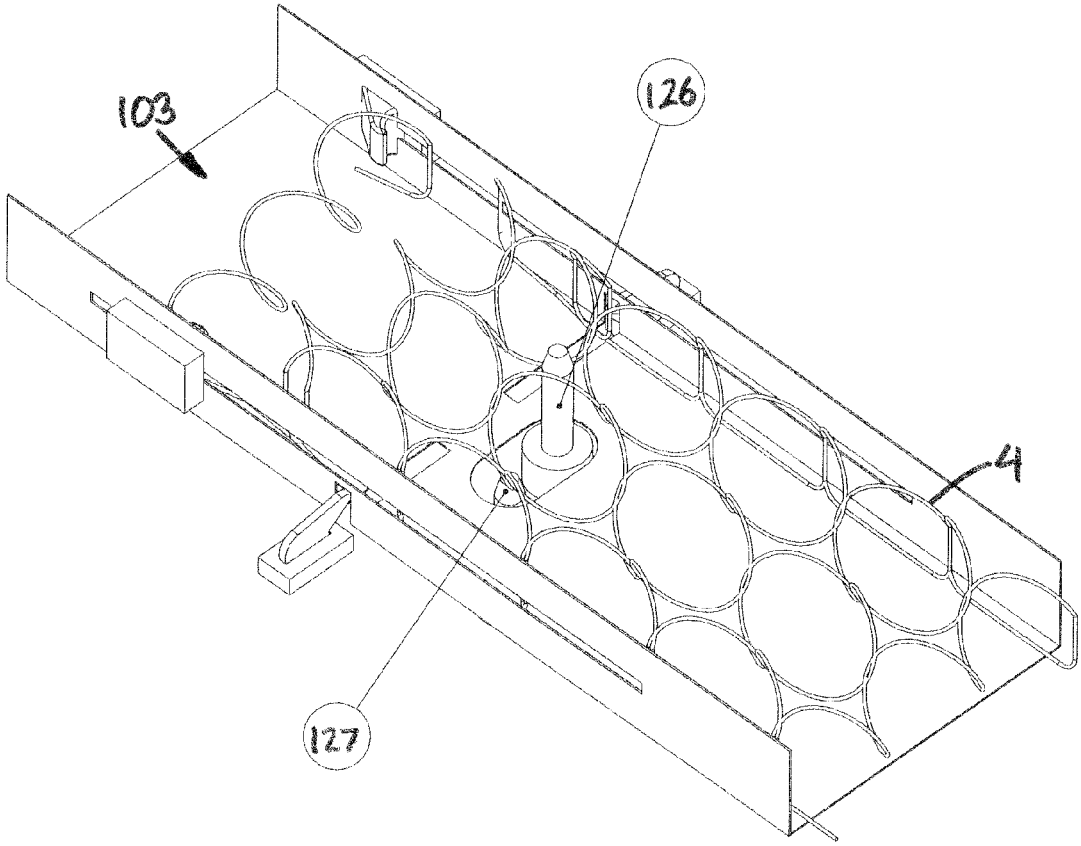
FIG. 10 is a perspective schematic overview of the linking table and the partly linked helical wire coil of FIG. 5 shown at a fifth step in the linking operation.

In FIG. 10, the left hand retaining pin 127 retracts downwardly out of the linking channel 103 and the right hand retaining pin 126 extends upwardly into the linking channel 103. The ratchet indexer 129 (shown in FIG. 6) is then actuated to slide downstream along the guide channel 130 such that the downwardly extending indexing fingers 134, 135 engage the wire coil 4 and advance it a predetermined distance downstream so as to correctly position the left hand portion 6*b* of the right handed coil 6 for interlinking with the left hand portion 5'*b* of the next upstream left handed coil 5'. As mentioned above, to complete a linking operation, the above process should then be repeated but by operating the opposite member of each pair of components, e.g. the process will begin by actuation of left hand compression finger 109 and left hand hook 121.

Figure 11:
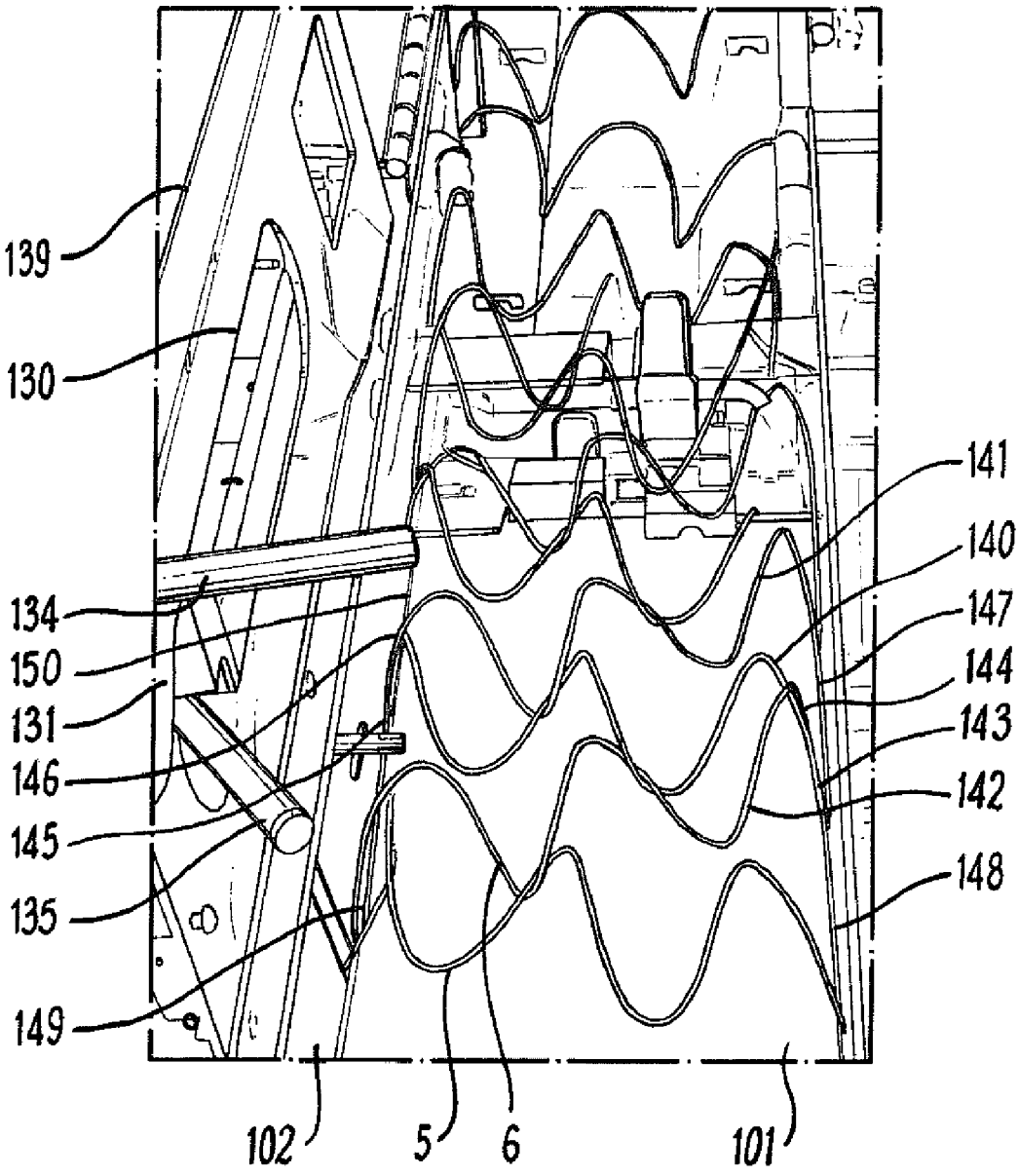
FIG. 11 is a photograph taken from a downstream position of the linking table of the present invention with a partly linked helical wire coil.
Figure 12:
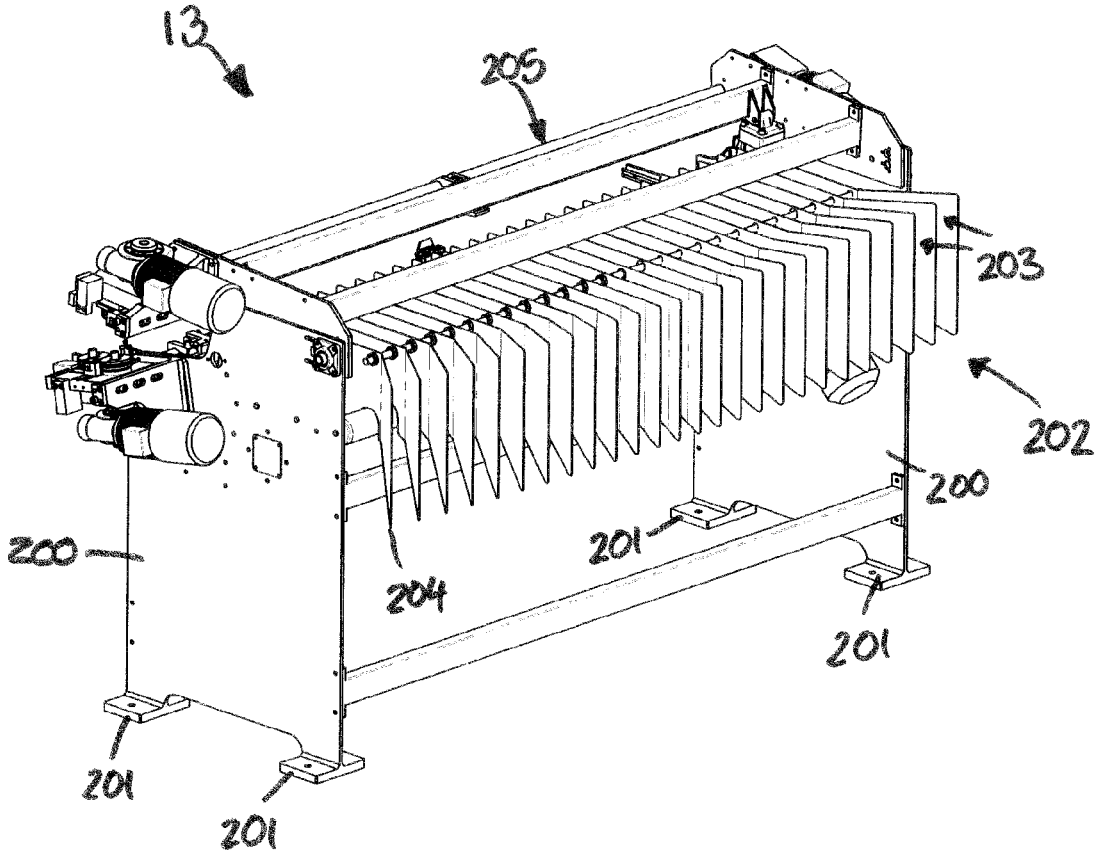
FIG. 12 is a perspective schematic overview of a spring unit assembly machine in accordance with an aspect of the present invention.

FIG. 11 illustrates the assembly 1 as shown schematically in FIG. 5 together with the indexer 129 as shown in FIG. 6. As can be seen from FIG. 7, the indexer 129 is slidably received in the guide channel 130 which is defined in a lid 139 which is hingedly connected to the side wall 102. FIG. 11 also illustrates the interlinking of adjacent coils 5, 6. As can clearly be seen, coil 140 has been linked to adjacent upstream and downstream coils 141, 142. A right hand portion 143 of coil 140 overlaps a right hand portion 144 of downstream coil 142 and a left hand portion 145 of upstream coil 141 overlaps a left hand portion 146 of coil 140, with all adjacent longer straight sections of wire 147, 148, 149, 150 lying approximately parallel to one another.

It will be understood that numerous modifications can be made to the embodiment of the invention described above without departing from the underlying inventive concept and that these modifications are intended to be included within the scope of the invention. For example, the compression fingers can be operated alternately as described above or can be operated together. Moreover, the dimensions and relative locations of the various components can be varied to suit a given coil size and number of helical repeats in each coil. It is envisaged that the hooks, retaining pins, compression fingers and indexing fingers may be of any suitable size and shape provided each can still perform its designated function as described above. The above example employs pneumatically actuated linearly moving components which are cheap and reliable, although, any convenient actuating means can be used for any of the various components. The provision of the hinged lid carrying the indexer is optional but may be preferable in view of ensuring the safety of workers operating the machine. The heat treatment step may be carried out using any appropriate number and arrangement of electrode or, alternatively, may be carried out in an oven as in conventional processes of this kind.

The spring coil assembly machine 13 is shown in detail in FIGS. 12 to 20 and receives the strings of coils 10 from storage reels 11 (FIG. 1). The machine has two floor-standing side frames 200 each with a pair of feet 201 that are fixed to the floor. The frames 200 carry an inlet unit 202 in the form of a plurality of guide channels 203 defined between spaced parallel upright plates 204, a coil string 10 being received in each channel 203. This inlet unit 202 is shown in more detail in FIGS. 13 and 14. The coil strings are drawn through the inlet by an indexing device (not shown) that indexes the strings by one coil width at a time to a binding station 205. The indexing device is of conventional construction and will not be described in detail here. The binding station 205 comprises upper and lower sets of transversely extending jaw pairs 15 that serve to clamp the coil strings 10 with their longitudinal axes substantially upright whilst the adjacent strings 10 are bound together. The jaws are described in more detail below with reference to FIGS. 15 to 18.

Figure 13:
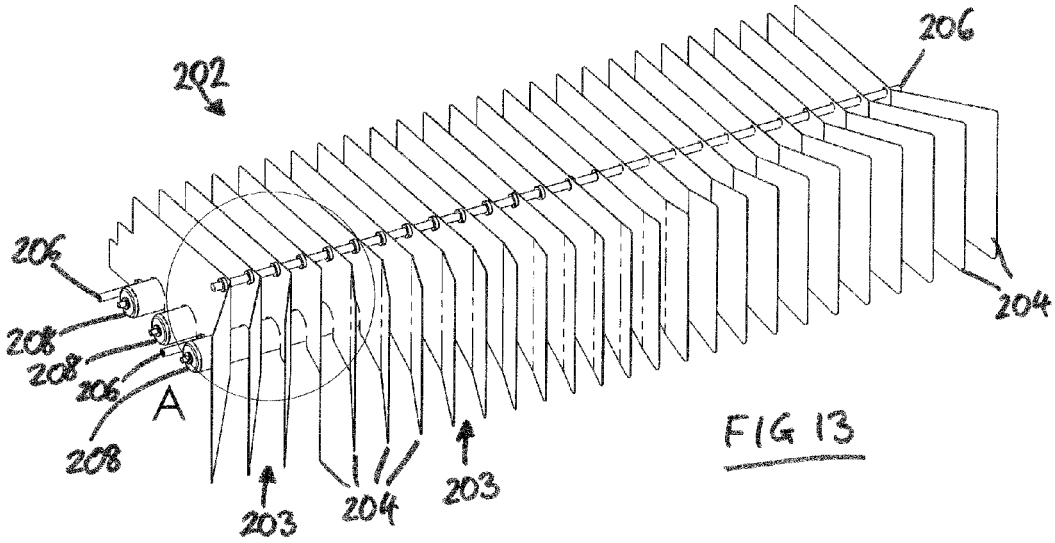
FIG. 13 is a perspective schematic view of an inlet unit of the spring unit assembly machine shown in FIG. 12.
Figure 14:
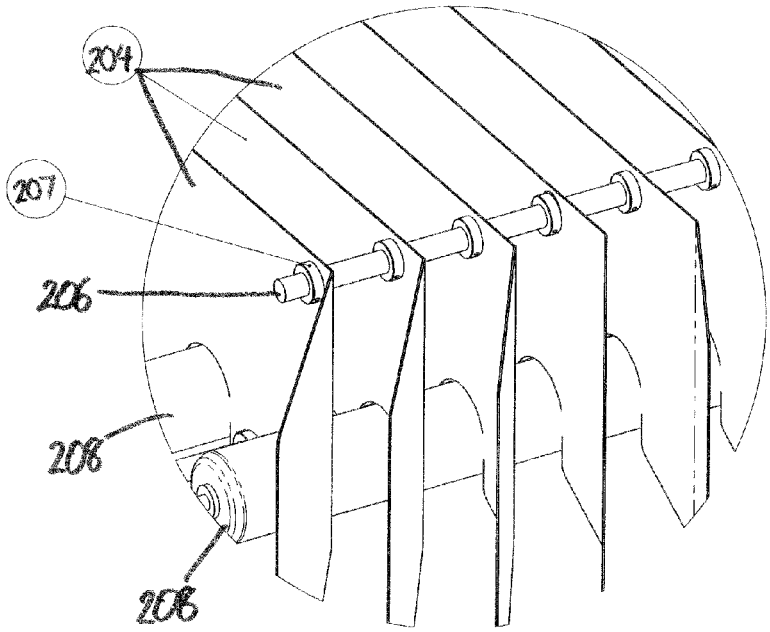
FIG. 14 is a perspective schematic view of a detailed section of the inlet unit shown in FIG. 13.
Figure 15:
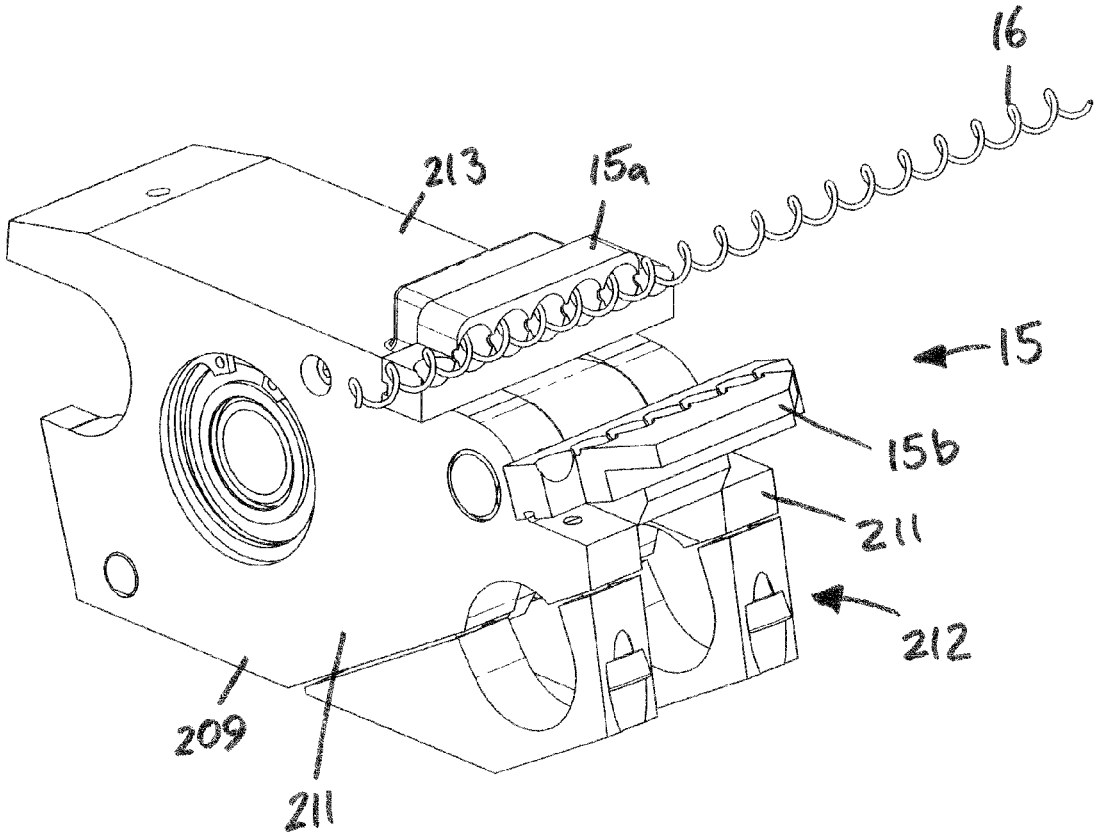
FIG. 15 is a perspective schematic view of a jaw pair forming part of the spring unit assembly machine of FIG. 12, the jaw pair is shown in an open position with a helical binding wire held in an upper jaw of the jaw pair.

The upright guide plates 204 of inlet unit 202 are slidably supported on three parallel rods 206 that extend between the side frames 200 and through apertures in the plates 203. The position of the plates 204 on the rods 206 is slidably adjustable so that the number and size of channels 203 can be varied according to the application and size of the spring unit being produced. When the size and number of channels 203 is finalised the position of each plate 204 is fixed relative to the rods 206 by locking collars 207 disposed on each side of the plate 204 around the apertures. The collars 207 are locked in place on the rods 206 by worm screws or the like. At the base of each channel 203 the strings of coils 10 are supported for forward movement on cylindrical rollers 208. Three such spaced rollers 208 are shown in FIG. 13, each extending in parallel to the support rods 206 and between the side frames 200. The outermost of the plates 204 are bent out of their parallel planes towards the side frames 200 so as to define channels 203 that flare outwardly with increasing amounts towards the side frames 200. This allows the strings of coils 10 to be received from storage reels 11 that are laterally spaced by a distance greater than that of the inlet unit 202. It will be appreciated that the inlet unit design is fully adjustable to accommodate the manufacture of different sizes of spring units.

Figure 19:
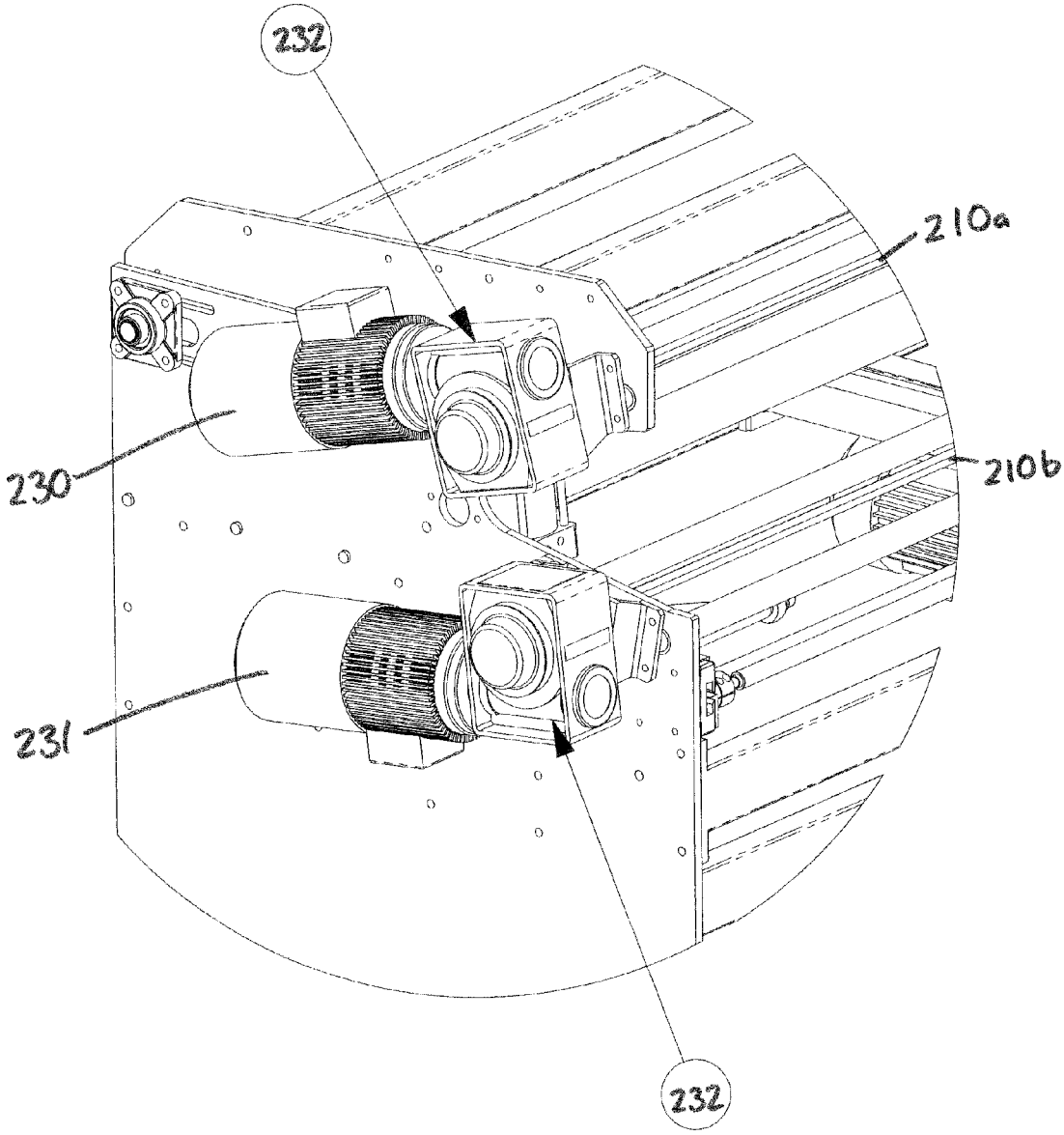
FIG. 19 is a perspective schematic view of a pair of servomotors which are used to drive a pair of drive shafts operably connected to upper and lower pairs of jaws.
Figure 20:
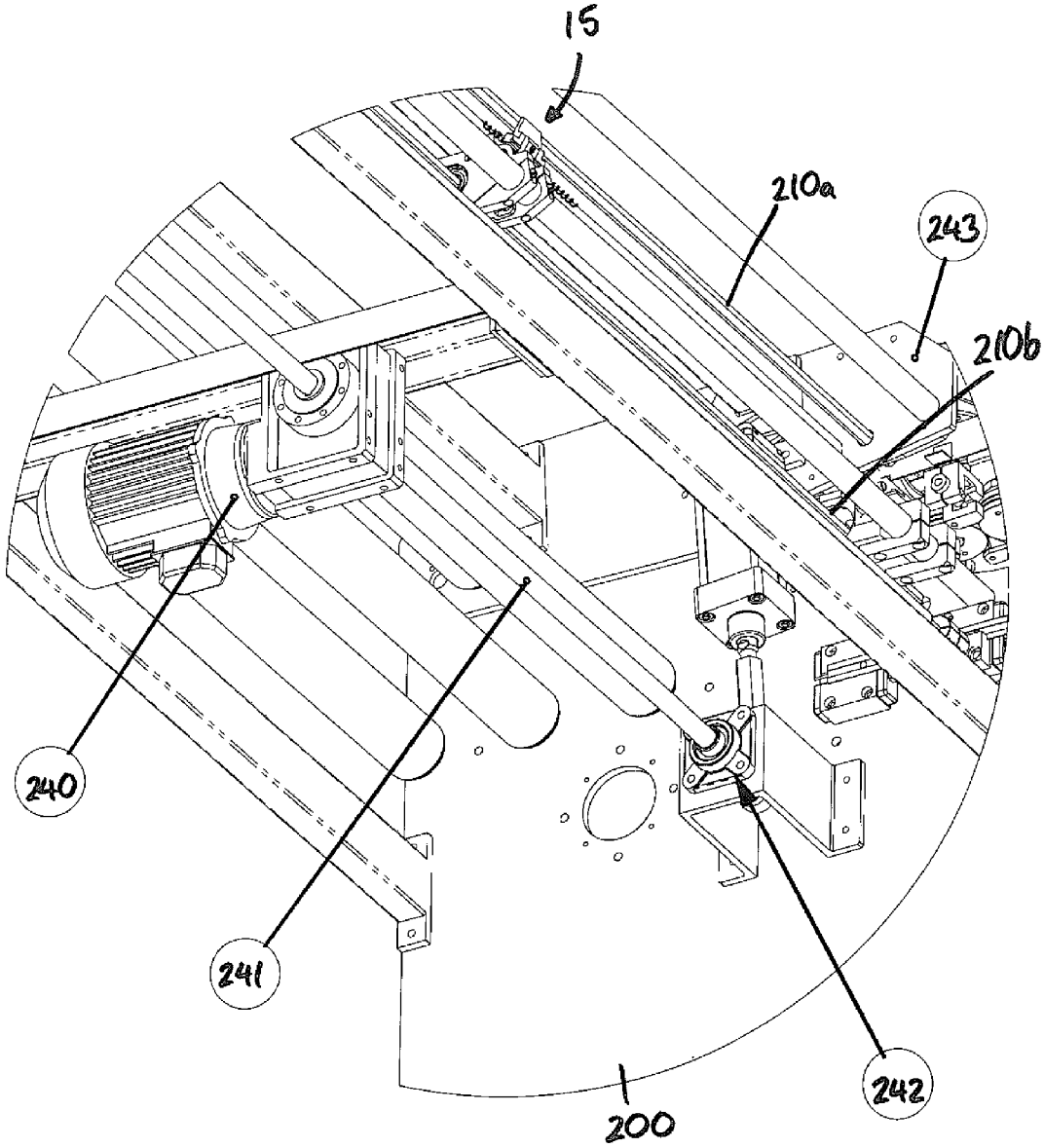
FIG. 20 is a perspective schematic view of a motor used to drive a shaft which is used to raise and lower the upper jaw of each jaw pair for servicing and maintenance.

The upper and lower sets of jaw pairs 15 are arranged in two lines along the width of the assembly machine 13 and each pair combine, when closed, to form a continuous helical channel into which a helical binding wire 16 is advanced. The jaws 15 are disposed such that their mouths face away from the inlet unit 202. Each jaw pair 15 comprises an upper fixed jaw 15*a* and a lower pivotal jaw 15*b*, both of which are supported by a jaw body 209 that is mounted on a transverse drive shaft spanning the width of the assembly machine 13. Upper and lower drive shafts 210*a* and 210*b* of hexagonal cross section are used for the upper and lower jaw sets 15 and are best seen in FIGS. 19 and 20 (in which the inlet unit guide plates 204 have been removed for clarity) where only one pair of jaws 15 (FIG. 20) from the lower jaw set is shown in-situ on the shaft 210*b* for clarity. As can be seen from FIGS. 15 to 17 the main body 209 has two depending side walls 211 that are spaced apart and flank a linkage 212 that operates the movable lower jaw 15*b* and an upper wall 213 to which the upper jaw 15*a* is fixed. The jaws 15 are shown in the open position in FIG. 15 and in the closed position in FIG. 16. The binding wire 16 is formed by passing uncoiled wire 17 from a reel 18 to a coiling passage 19 located to the side of the jaws 15 of the assembly machine 13 in a known arrangement and as shown schematically in FIG. 1. It is rotated and axially advanced in the transverse direction of arrow B (FIG. 1) through the jaws 15 such that it passes around the wire of the adjacent strings 10 in order to bind the coil strings 10 together. The jaw sets 15 are then opened and the joined strings of coils 10 indexed forward so as to locate the next coil of each string 10 within the jaws 15 whereupon the above cycle is repeated to bind the next row of coils together. The binding cycle is repeated a sufficient number of times to bind a suitable number of rows of coils together to produce a spring unit of the desired size.

Figure 16:
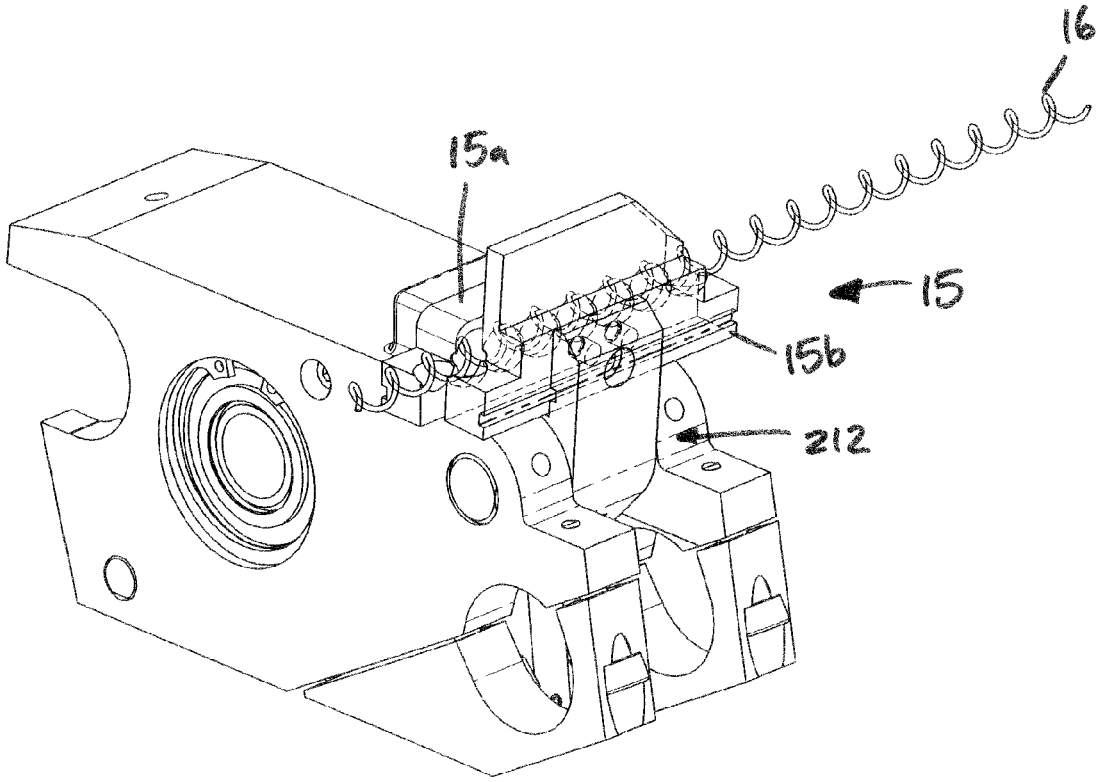
FIG. 16 is a perspective schematic view of the jaw pair of FIG. 15 in a closed position with a helical binding wire held between the upper and lower jaws of the jaw pair.
Figure 18:
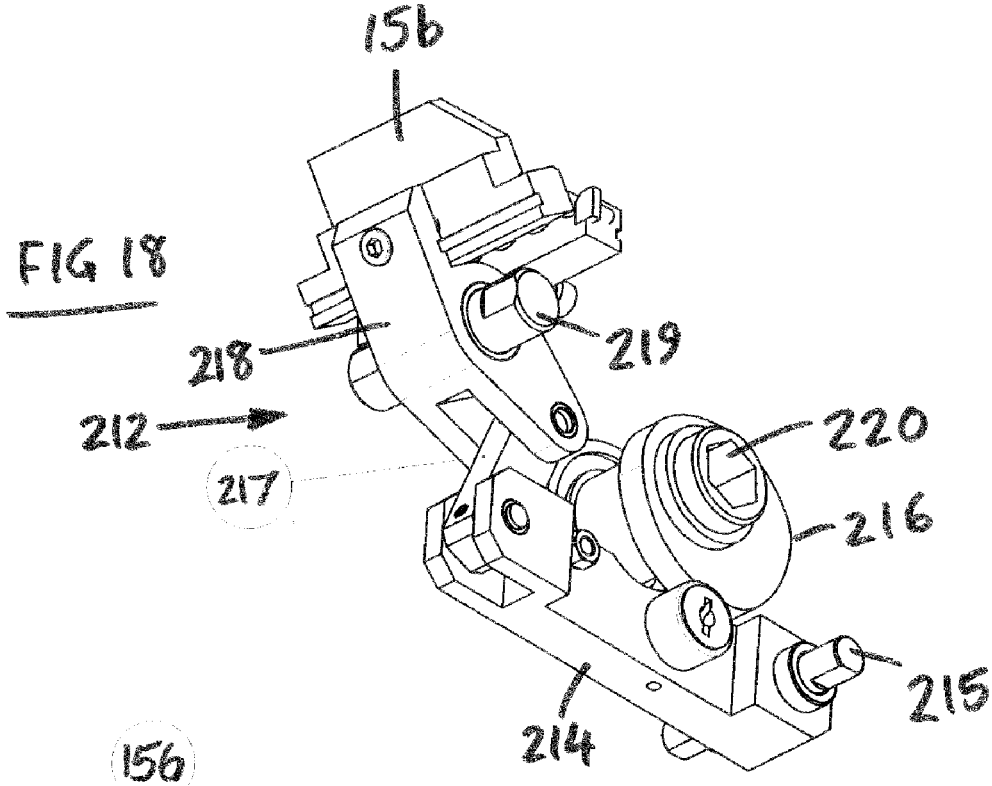
FIG. 18 is a perspective schematic view of the lower jaw of the jaw pair of FIGS. 15 and 16 shown with the main body removed.
Figure 17:
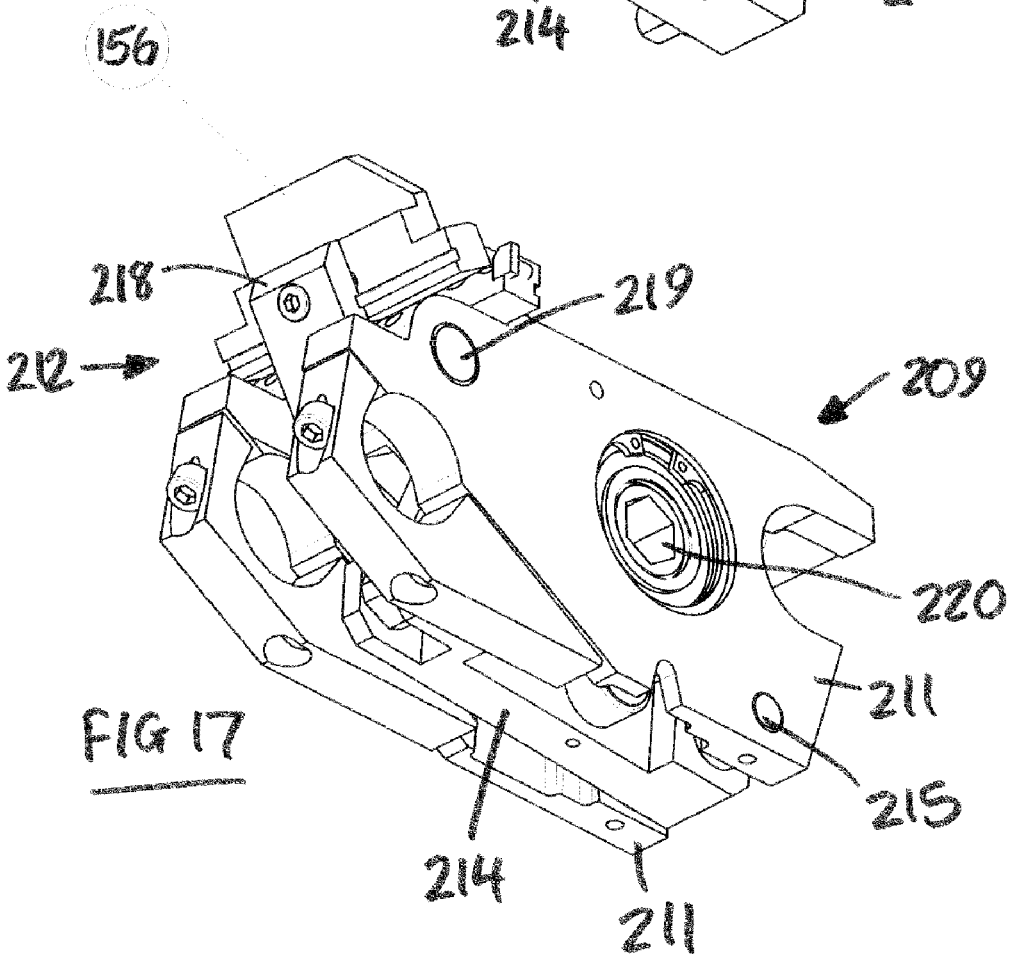
FIG. 17 is a perspective schematic view of the lower jaw and main body of the jaw pair of FIGS. 15 and 16.

The mechanism of the lower jaw 15*b* is shown in detail in FIGS. 17 and 18 with the main body 209 of the jaws 15 removed for clarity in FIG. 18. The lower jaw 15*b* is connected to the main body 209 by the linkage 212 that enables it to pivot between the open and closed positions. The linkage 212 comprises a cam follower arm 214 that is pivotally connected to the rear of each side wall 211 of the main body 209 by a shaft 215 and rests immediately below the peripheral surface of an eccentric disc cam 216. The end of the cam follower arm 214 is connected by a link member 217 to one end of a pivoting arm 218, the other end of which supports the lower jaw 15*b*. The pivoting arm 218 pivots on a shaft 219 that is received between the side walls 211 at the front end of the main body 209. The eccentric disc cam 216 is received between the side walls 211 between the front and rear ends of the main body 209 and is mounted on the hexagonal drive shaft 210*a*, 210*b* by means of a bore 220 of the same shape cross-section. The jaw 15 is shown in FIGS. 17 and 18 in between the fully open position and the closed positions. As the drive shaft 210*a,b* rotates in the clockwise direction in the view of FIG. 18 the cam 216 is similarly rotated clockwise and the lever arm 214 pivots downwardly about the rear shaft 215. This serves to pull the rear end of the pivot arm 218 downwardly so that other end and therefore the jaw 15*b* moves in a upwards direction towards the upper fixed jaw 15*a* to the closed position as shown in FIG. 16.

It will thus be appreciated that all of the jaws 15 of a given jaw set can be opened and closed simultaneously by simple rotation of a drive shaft to drive the eccentric disc cams and linkages associated with each of the lower jaws. It is to be understood that the mechanism could be easily adapted to pivot the upper jaw with respect to the lower jaw. The linkage enables a relatively small movement provided by the cam to the lever arm to be translated into a larger movement of the jaw.

The drive shafts 210*a*, 210*b* for the upper and lower sets of jaws 15 are each driven by a servomotor 230, 231 that is mounted on one of the side frames 200. Each servomotor 230, 231 is connected to the shaft 210*a*, 210*b* via a gear box 232 fitted with a torque limiter. This arrangement provides a safety feature in the event that one of the jaws 15 is jammed. It ensures that if the torque applied to the drive shafts 210*a*, 210*b* should exceed a predetermined value the drive is disconnected.

A further motor 240 is disposed below the binding station 205 and drives a shaft 241 that rotates an adjustable eccentric cam 242 which carries a frame 243 that supports the main body 209 of the jaws 15. This arrangement enables the fixed upper jaws 15*a* to be moved if necessary for maintenance or servicing purposes.

While the inventions have been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. Coil formation apparatus for manufacturing spring coils from continuous wire, the coils being arranged to be of alternating left and right-handed coils along the wire, the apparatus comprising a coil forming device and means for feeding the wire to the device, the device comprising a pivotally disposed body providing support for a coil radius forming roller against which the wire bears to form an arcuate shape and a guide member defining an opening from which the coiled wire emerges, the guide member being pivotally disposed relative to the body such that it can pivot between a first position where the opening is aligned with the wire emerging from the roller so that it passes therethrough without further deformation and at least one second position where it is misaligned and bears against the wire thus imparting deformation to the wire that gives the coil its axial pitch, an angle of pivotal movement of the guide member being controlled by an adjustable drive mechanism that comprises a rotary drive shaft driven by a servomotor in response to instructions sent by a controller, the drive shaft being connected to the guide member by a transmission linkage that converts rotary movement of the drive shaft into translational movement of a link member and converts the translational movement of the link member to pivotal movement of the guide member as the body is pivoted, the link member comprising a connecting rod connected to a radius arm of the drive shaft by means of an adjustable connection.

2. Coil formation apparatus according to claim 1, wherein the guide Member is pivotal between two second positions, one to each side of the first position.

3. Coil formation apparatus according to claim 1, wherein the adjustable connection comprises an arm to which an end of the connecting rod is pivotally connected, a position of the end of the connecting rod being adjustable by an adjustment element.

4. Coil formation apparatus according to claim 3, wherein the adjustment element is a screw that is rotatable in one direction to bear against the end of the connecting rod and move it radially closer to the centre of rotation of the drive shaft.

5. Coil formation apparatus according to claim 4, wherein the arm has a slot, and a fixing member passes through the end of the connecting rod and the slot so as to connect the connecting rod to the arm, the adjustment element being adapted to move the end of the rod along the slot.

6. Coil formation apparatus according to claim 5, wherein the Adjustment element bears against the fixing member.

7. Coil formation apparatus according to claim 1, wherein the transmission linkage comprises a sliding yoke that is connected to the connecting rod and slides along a shaft on which the body is mounted for pivotal movement.

8. Coil formation apparatus according to claim 1, wherein the translational movement of the link member is converted into pivotal movement of the guide member by a cam and cam follower comprising a bar with a spiral cam groove in which a pin is received, the axial movement of the bar being restrained such that movement of the pin relative to the bar along the cam groove causes rotation of the bar and therefore pivoting movement of the guide member.

* * * * *